US011408416B2

(12) United States Patent
Mitchell et al.

(10) Patent No.: US 11,408,416 B2
(45) Date of Patent: Aug. 9, 2022

(54) PUMP SYSTEM WITH PINCH VALVE FOR FLUID MANAGEMENT IN SURGICAL PROCEDURES AND METHOD OF OPERATION THEREOF

(71) Applicants: SMITH & NEPHEW, INC., Memphis, TN (US); SMITH & NEPHEW ORTHOPAEDICS AG, Zug (CH); SMITH & NEPHEW ASIA PACIFIC PTE. LIMITED, Singapore (SG)

(72) Inventors: Mathew Mitchell, Pelham, NH (US); Mikhael Lyssounkine, Toulouse (FR); William Sant, Montgiscard (FR)

(73) Assignees: SMITH & NEPHEW, INC., Memphis, TN (US); SMITH & NEPHEW ORTHOPAEDICS AG, Zug (CH); SMITH & NEPHEW ASIA PACIFIC PTE. LIMITED, Singapore (SG)

( * ) Notice: Subject to any disclaimer, the term of this patent is extended or adjusted under 35 U.S.C. 154(b) by 0 days.

(21) Appl. No.: 17/109,525

(22) Filed: Dec. 2, 2020

(65) Prior Publication Data

US 2022/0065239 A1 Mar. 3, 2022

Related U.S. Application Data

(60) Provisional application No. 63/073,575, filed on Sep. 2, 2020.

(51) Int. Cl.
*F04B 43/12* (2006.01)
*F04B 17/04* (2006.01)
*F04B 45/067* (2006.01)

(52) U.S. Cl.
CPC ..... *F04B 43/1292* (2013.01); *F04B 17/04* (2013.01); *F04B 45/067* (2013.01)

(58) Field of Classification Search
None
See application file for complete search history.

(56) References Cited

U.S. PATENT DOCUMENTS 5,000,733 A 3/1991 Mathies et al.
5,215,450 A * 6/1993 Tamari ..... A61M 1/3639 417/474

(Continued)

OTHER PUBLICATIONS

NResearch Incorporated, NResearch Catalog, Jun. 1998, (retrieved from http://www.nresearch.com, Jan. 2022, pp. 1-12) (Year: 1998).*

*Primary Examiner* — Peter J Bertheaud
*Assistant Examiner* — Geoffrey S Lee
(74) *Attorney, Agent, or Firm* — Dickinson Wright, PLLC; Charles W. Kocher; Mark E. Scott

(57) ABSTRACT

Pump systems with pinch valves for surgical procedures. At least some of the example embodiments are pump systems including a stationary housing defining a front face. A tube support extends outwardly from the front face for aligning and supporting a first tube and a second tube. At least one pinch member is movable relative to the tube support by a power actuator operably coupled to the at least one pinch member and configured to have three orientations that define: a first arrangement of the pinch member relative to the tube support configured to pinch closed the first tube, a second arrangement of the at least one pinch member relative to the tube support configured to pinch closed the second tube, and a third arrangement of the at least one pinch member relative to the tube support configured to pinch closed neither the first tube nor the second tube.

5 Claims, 20 Drawing Sheets

(56) References Cited

U.S. PATENT DOCUMENTS

| | | | | |
|---|---|---|---|---|
| 6,889,121 | B1 * | 5/2005 | Shahroudi | H01F 7/1805 251/129.18 |
| 8,206,342 | B2 | 6/2012 | Hacker et al. | |
| 8,591,453 | B2 | 11/2013 | Stubkjaer et al. | |
| 9,308,315 | B2 | 4/2016 | Stubkjaer et al. | |
| 10,369,270 | B2 | 8/2019 | Stubkjaer et al. | |

* cited by examiner

1004
Y
202
206
1110
$C_3$
1112
1100

208
202
206
174
1106
1104
$C_3$
1110
204
1108
1112
172
1102
1100
Y
X 208
202
206
174
1106
1104
$C_3$
1110
204
1112
11C
172
1102
1100
1108
11C
Y
X

PUMP SYSTEM WITH PINCH VALVE FOR FLUID MANAGEMENT IN SURGICAL PROCEDURES AND METHOD OF OPERATION THEREOF

CROSS-REFERENCE TO RELATED APPLICATIONS

This application claims the benefit of U.S. Provisional Application Ser. No. 63/073,575 filed Sep. 2, 2020 titled "Pump System with Pinch Valve for Fluid Management in Surgical Procedures and Method of Operation Thereof." The provisional application is incorporated by reference herein as if reproduced in full below.

BACKGROUND

Arthroscopic surgical procedures are procedures performed on a joint, such as a knee or shoulder, of a patient. In order to provide space within the joint to perform the procedure, the joint may be distended using a surgical fluid (e.g., saline solution). However, surgical procedures within a joint sometimes result in minor bleeding and create tissue fragments, which can cloud visibility within the joint. To maintain visibility, both inflow and outflow pumps may be employed to provide a continuous fluid flow through the joint. Outflow can occur from multiple sources including various surgical devices; however, depending on the device in use, it may be desired to control the outflow from a particular one of the surgical devices at any given time.

SUMMARY

There is provided a pump system including an outflow pump. The pump system includes a stationary housing that defines an internal volume and a front face outside the internal volume extending in a first direction and a second direction transverse to the first direction. The stationary housing includes at least one tube support outside the internal volume extending outwardly from the front face for aligning and supporting a first tube and a second tube. At least one pinch member is movable relative to the at least one tube support. A power actuator is disposed in the internal volume and is operably coupled to the at least one pinch member. The power actuator is configured to have three orientations that define: a first arrangement of the at least one pinch member relative to the at least one tube support configured to pinch closed the first tube, a second arrangement of the at least one pinch member relative to the at least one tube support configured to pinch closed the second tube, and a third arrangement of the at least one pinch member relative to the at least one tube support configured to pinch closed neither the first tube nor the second tube.

In some embodiments, the at least one tube support includes a t-shaped bracket having a central post that extends outwardly from the front face along a longitudinal central axis. The t-shaped bracket also includes a support beam that is attached to and extends across the central post and is spaced from and extends along the front face in the second direction. The t-shaped bracket defines a bracket cavity leading to the internal volume and extending through the central post and into the support beam. The t-shaped bracket defines a first tube notch that is configured to accept the first tube and a second tube notch that is configured to accept the second tube.

In some embodiments, the power actuator includes a sliding shaft that extends along the longitudinal central axis through the front face and out of the internal volume into the bracket cavity. The power actuator also includes a solenoid assembly coupled to the sliding shaft. The sliding shaft is movable by the solenoid assembly along the longitudinal central axis to: a first translational position to move the at least one pinch member to the first arrangement, a second translational position to move the at least one pinch member to the second arrangement, and a third translational position to move the at least one pinch member to the third arrangement.

In some embodiments, the at least one pinch member includes a first pinch bar that extends radially from the longitudinal central axis at a distal end of the sliding shaft in a first lateral direction. The first pinch bar extends along the support beam into the bracket cavity adjacent the first tube notch. The first pinch bar is configured to move toward the front face when the sliding shaft is moved to the first translational position. The first pinch bar is also configured to maintain spacing of a first notch width with the front face when the sliding shaft moves to the third translational position. The at least one pinch member also includes a second pinch bar that extends radially from the longitudinal central axis in a second lateral direction opposite the first lateral direction. The second pinch bar extends into the bracket cavity and is offset from the first pinch bar along the longitudinal central axis by a second notch width. The second pinch bar extends along and is spaced from the support beam. The second pinch bar is configured to move away the front face when the sliding shaft is moved to the second translational position. The second pinch bar is also configured to maintain spacing of the second notch width with the front face when the sliding shaft moves to the third translational position.

In some embodiments, the solenoid assembly includes a first solenoid that has a first coil fixedly attached to the stationary housing. The first solenoid also has a first solenoid core extending and movable along a first core axis in parallel to the longitudinal central axis. The first solenoid is configured to move the first solenoid core in a first core direction along the first core axis from a first core initial position corresponding to the third translational position of the sliding shaft to a first core extended position corresponding to the first translational position of the sliding shaft in response to the first coil being energized. The first solenoid is configured to return the first solenoid core the first core initial position in response to the first coil not being energized. The solenoid assembly also includes a second solenoid that has a second coil fixedly attached to the stationary housing. The second solenoid also has a second solenoid core that extends and is movable along a second core axis in parallel to the longitudinal central axis and spaced from the first core axis. The second solenoid is configured to move the second solenoid core in a second core direction along the second core axis opposite the first core direction from a second core initial position corresponding to the third translational position of the sliding shaft to a second core extended position corresponding to the second translational position of the sliding shaft in response to the second coil being energized. The second solenoid is configured to return the second solenoid core to the second core initial position in response to the second coil not being energized. The solenoid assembly additionally includes a z-shaped bracket that includes a central portion extending rectilinearly in parallel to the longitudinal central axis. The z-shaped bracket includes a first arm that extends orthogonally to the longitudinal central axis and is attached to the first solenoid core and the sliding shaft. The z-shaped bracket also includes a second arm that extends orthogonally to the longitudinal central axis and is attached to the second solenoid core for moving the sliding shaft along the longitudinal central axis.

In some embodiments, the pump system further includes a solenoid controller coupled to the solenoid assembly. The solenoid controller is configured to reduce a voltage supplied to the solenoid assembly from an initial voltage to a predetermined reduced voltage after a predetermined amount of time. The reduction of the voltage supplied to the solenoid assembly from the initial voltage to the predetermined reduced voltage after the predetermined amount of time reduces an amount of power required to maintain a pinch applied by the at least one pinch member in the first translational position of the sliding shaft and by the at least one pinch member in the second translational position of the sliding shaft in the second translational position of the sliding shaft.

In some embodiments, the at least one tube support includes a central barrier extending outwardly from the front face. The central barrier has a first central barrier side that extends along the first direction and a second central barrier side opposite the first central barrier side that extends along the first direction. The at least one pinch member includes a first movable component extending outwardly from the front face and is selectively spaced from the first central barrier side of the central barrier. The first movable component is movable along the second direction toward the first central barrier side of the central barrier. The at least one pinch member also includes a second movable component that extends outwardly from the front face and is selectively spaced from the second central barrier side of the central barrier. The second movable component is movable along the second direction toward the second central barrier side of the central barrier. The power actuator includes at least one motor that is operably coupled to the first movable component and the second movable component. The at least one motor is configured to move the first movable component toward the first central barrier side of the central barrier to pinch the first tube against the first central barrier side of the central barrier in the first arrangement. The at least one motor is also configured to move the first movable component away from the first central barrier side of the central barrier to release the first tube in the third arrangement. In addition, the at least one motor is configured to move the second movable component toward the second central barrier side of the central barrier to pinch the second tube against the second central barrier side of the central barrier in the second arrangement. The at least one motor is also configured to move the second movable component away from the second central barrier side of the central barrier to release the second tube in the third arrangement.

In some embodiments, the first movable component and the second movable component are configured to slide along the second direction and the at least one motor includes a first motor and a second motor.

In some embodiments, the first movable component and the second movable component are oblong and configured to rotate about respective axes extending orthogonally from the front face and spaced from one another.

In some embodiments, the at least one tube support includes a first barrier extending outwardly from the front face and having a first barrier edge extending along the first direction for facing the first tube. The at least one tube support also includes a second barrier extending outwardly from the front face opposite and spaced from the first barrier and having a second barrier edge extending along the first direction for facing the second tube. In addition, the at least one pinch member includes a central movable component that extends outwardly from the front face between the first barrier and the second barrier. The central movable component is selectively spaced from the first barrier and the second barrier and is movable toward one of the first barrier and the second barrier. The power actuator includes at least one motor operably coupled to the central movable component and is configured to move the central movable component toward the first barrier edge of the first barrier to pinch the first tube against the first barrier edge of the first barrier in the first arrangement. The at least one motor is also configured to move the central movable component away from the first barrier edge of the first barrier to release the first tube in the third arrangement. Additionally, the at least one motor is configured to move the central movable component toward the second barrier edge of the second barrier to pinch the second tube against the second barrier edge of the second barrier in the second arrangement. The at least one motor is also configured to move the central movable component away from the second barrier edge of the second barrier to release the second tube in the third arrangement.

In some embodiments, the first barrier edge and the second barrier edge directly face one another and the central movable component extends along the second direction from a first central component end to a second central component end. The at least one motor includes a central component shaft extending through the front face. The central component shaft is rotatable about a first central component end axis disposed at the first central component end. The central component shaft connects to the first central component end. The central component shaft is configured to rotate the central movable component about the first central component end axis to rotate the second central component end of the central movable component toward the first barrier edge of the first barrier to pinch the first tube against the first barrier edge of the first barrier in the first arrangement. The central component shaft is also configured to rotate the central movable component about the first central component end axis to rotate the second central component end of the central movable component away from the first barrier edge of the first barrier to release the first tube in the third arrangement. Additionally, the central component shaft is configured to rotate the second central component end of the central movable component toward the second barrier edge of the second barrier to pinch the second tube against the second barrier edge of the second barrier in the second arrangement. The central component shaft is also configured to rotate the central movable component about the first central component end axis to rotate the second central component end of the central movable component away from the second barrier edge of the second barrier to release the second tube in the third arrangement.

In some embodiments, the first barrier and the second barrier are offset from one another along the first direction and the first barrier edge and the second barrier edge do not directly face one another. The central movable component extends in the second direction from a first central component side to a second central component side opposite the first central component side. The at least one motor is configured to move the central movable component along the second direction to slide the central movable component toward the first barrier to pinch the first tube between the first central component side and the first barrier edge of the first barrier in the first arrangement. The at least one motor is also configured to move the central movable component along the second direction to slide the central movable component away from the first barrier to release the first tube from between the first central component side and the first barrier edge of the first barrier in the third arrangement. In addition, the at least one motor is configured to slide the central movable component toward the second barrier to pinch the second tube between the second central component side and the second barrier edge of the second barrier in the second arrangement. The at least one motor is configured to move the central movable component along the second direction to slide the central movable component away from the second barrier to release the second tube from between the second central component side and the second barrier edge of the second barrier in the third arrangement.

In some embodiments, the first tube and the second tube both attach to a connector and combine into an outflow tube exiting the connector. The at least one pinch member includes a movable portion of the connector configured to move relative to the front face. The power actuator includes a motor operably coupled to the movable portion of the connector. The motor is configured to move the movable portion of the connector to pinch closed the first tube in the first arrangement. The motor is also configured to move the movable portion of the connector to pinch closed the second tube in the second arrangement. Additionally, the motor is configured to move the movable portion of the connector to pinch closed neither the first tube nor the second tube in the third arrangement.

In some embodiments, the power actuator includes a solenoid assembly including a first solenoid having a first coil fixedly attached to the stationary housing and having a first solenoid core extending and movable along a first core axis in parallel to a longitudinal central axis. The first solenoid is configured to move the first solenoid core in a first core direction along the first core axis. The first solenoid core is movable from a first core initial position corresponding to the third arrangement of the at least one pinch member to a first core extended position corresponding to the first arrangement of the at least one pinch member in response to the first coil being energized. The first solenoid core is also configured to return to the first core initial position in response to the first coil not being energized. The solenoid assembly also includes a second solenoid having a second coil fixedly attached to the stationary housing and having a second solenoid core extending and movable along a second core axis in parallel to the longitudinal central axis and spaced from the first core axis. The second solenoid is configured to move the second solenoid core in a second core direction along the second core axis being in the same direction as the first core direction. The second solenoid is movable from a second core initial position corresponding to the third arrangement of the at least one pinch member to a second core extended position corresponding to the second arrangement of the at least one pinch member in response to the second coil being energized. The second solenoid is also configured to return to the second core initial position in response to the second coil not being energized. The solenoid assembly also includes a first shaft half coupled to the first solenoid core by a first bracket half extending transverse to the first core axis from the first solenoid core toward the longitudinal central axis. In addition the solenoid assembly includes a second shaft half coupled to the second solenoid core by a second bracket half extending transverse to the second core axis from the second solenoid core toward the longitudinal central axis. The at least one pinch member includes a first half pinch bar extending radially from the longitudinal central axis in a first lateral direction. The first half pinch bar is configured to move away the front face when the first shaft half is in a primary first shaft half position corresponding to the first arrangement of the at least one pinch member while maintaining spacing with the front face when the first shaft half is in a tertiary first shaft half position corresponding to the third arrangement of the at least one pinch member. The at least one pinch member also includes a second half pinch bar extending radially from the longitudinal central axis in a second lateral direction opposite the first lateral direction. The second half pinch bar is configured to move away the front face when the second shaft half is in a primary second shaft half position corresponding to the second arrangement of the at least one pinch member while maintaining spacing with the front face when the second shaft half is in a tertiary second shaft half position corresponding to the third arrangement of the at least one pinch member.

There is also provided a method of operating a pump system including an outflow pump. The method including the step of providing a stationary housing defining an internal volume and a front face outside the internal volume extending in a first direction and a second direction transverse to the first direction and including at least one tube support outside the internal volume extending outwardly from the front face for aligning and supporting a first tube and a second tube. The method continues with the step of moving at least one pinch member relative to the at least one tube support using a power actuator operably coupled thereto amongst three orientations. The three orientations include: a first arrangement of the at least one pinch member relative to the at least one tube support configured to pinch closed the first tube; a second arrangement of the at least one pinch member relative to the at least one tube support configured to pinch closed the second tube; and a third arrangement of the at least one pinch member relative to the at least one tube support configured to pinch closed neither the first tube nor the second tube.

In some embodiments, the at least one tube support includes a t-shaped bracket extending outwardly from the front face and the power actuator includes a solenoid assembly coupled to a sliding shaft. Thus, the method further includes the step of providing a first tube notch defined by the t-shaped bracket and a second tube notch defined by the t-shaped bracket. The method also includes the step of moving the sliding shaft extending along a longitudinal central axis through the front face and out of the internal volume of the stationary housing and into a bracket cavity defined by the t-shaped bracket using the solenoid assembly between one of: a first translational position to move the at least one pinch member to the first arrangement, a second translational position to move the at least one pinch member to the second arrangement, and a third translational position to move the at least one pinch member to the third arrangement.

In some embodiments, the at least one pinch member includes a first pinch bar adjacent the first tube notch and a second pinch bar adjacent the second tube notch each extending radially from the longitudinal central axis and offset from one another along the longitudinal central axis. So, the method further includes the step of moving the first pinch bar toward the front face in response to the sliding shaft moving to the first translational position. The method also includes the step of moving the second pinch bar away from the front face toward a support beam of the t-shaped bracket spaced from the front face and extending along the second direction in response to the sliding shaft moving to the second translational position. In addition, the method includes the step of maintaining spacing of the first pinch bar from the front face of a first notch width and of the second pinch bar from the front face of a second notch width when the sliding shaft is in the third translational position.

In some embodiments, the solenoid assembly includes a first solenoid and a second solenoid. Consequently, the method further including the step of energizing a first coil of the first solenoid. Additionally, the method includes the step of moving a first solenoid core of the first solenoid in a first core direction along a first core axis in parallel to the longitudinal central axis from a first core initial position corresponding to the third translational position of the sliding shaft to a first core extended position corresponding to the first translational position of the sliding shaft in response to the first coil being energized. The method also includes the step of returning the first solenoid core to the first core initial position in response to the first coil not being energized. The next step of the method is energizing a second coil of the second solenoid. Next, moving a second solenoid core of the second solenoid in a second core direction along a second core axis in parallel to the longitudinal central axis opposite the first core direction from a second core initial position corresponding to the third translational position of the sliding shaft to a second core extended position corresponding to the second translational position of the sliding shaft in response to the second coil being energized. The method additionally includes the step of returning the second solenoid core to the second core initial position in response to the second coil not being energized.

In some embodiments, the method further includes the step of reducing a voltage supplied to the solenoid assembly from an initial voltage to a predetermined reduced voltage after a predetermined amount of time using a solenoid controller coupled to the solenoid assembly. Next, reducing an amount of power required to maintain a pinch applied by the at least one pinch member in the first translational position of the sliding shaft and by the at least one pinch member in the second translational position of the sliding shaft in the second translational position of the sliding shaft.

In some embodiments, the at least one tube support includes a central barrier extending outwardly from the front face. The at least one pinch member includes a first movable component and a second movable component each extending outwardly from the front face and selectively spaced from the central barrier. The power actuator includes at least one motor operably coupled to the first movable component and the second movable component. So, the method further includes the step of moving the first movable component toward a first central barrier side of the central barrier in the first arrangement. Also, the method includes the step of moving the first movable component away from the first central barrier side of the central barrier in the third arrangement. The method also includes the step of moving the second movable component toward a second central barrier side of the central barrier opposite the first central barrier side in the second arrangement. Additionally, the method includes the step of moving the second movable component away from the second central barrier side of the central barrier in the third arrangement.

In some embodiments, the at least one tube support includes a first barrier extending outwardly from the front face and a second barrier extending outwardly from the front face and spaced from the first barrier. The at least one pinch member includes a central movable component extending outwardly from the front face and disposed between the first barrier and the second barrier. The power actuator includes at least one motor operably coupled to the central movable component. Thus, the method further includes the step of moving the central movable component toward a first barrier edge of the first barrier extending along the first direction in the first arrangement. Also, the method includes the step of moving the central movable component away from the first barrier edge of the first barrier in the third arrangement. The method also includes the step of moving the central movable component toward a second barrier edge of the second barrier extending along the first direction in the second arrangement. In addition, the method includes the step of moving the central movable component away from the second barrier edge of the second barrier in the third arrangement.

In some embodiments, the first barrier edge and second barrier edge directly face one another and the central movable component extends along the second direction from a first central component end to a second central component end. Consequently, the method further includes the step of rotating the second central component end of the central movable component toward the first barrier edge of the first barrier in the first arrangement using a central component shaft of the at least one motor extending through the front face and rotatable about a first central component end axis disposed at the first central component end. The method continues with the step of rotating the second central component end of the central movable component away from the first barrier edge of the first barrier in the third arrangement using the central component shaft of the at least one motor. The method also includes the step of rotating the second central component end of the central movable component toward the second barrier edge of the second barrier in the second arrangement using the central component shaft of the at least one motor. The method proceeds by rotating the second central component end of the central movable component away from the second barrier edge of the second barrier in the third arrangement using the central component shaft of the at least one motor.

In some embodiments, the first barrier and the second barrier are offset from one another along the first direction and the first barrier edge and the second barrier edge do not directly face one another. The central movable component extends along the second direction from a first central component side to a second central component side. So, the method further includes the step of sliding the central movable component along the first direction toward the first barrier in the first arrangement using the at least one motor. Also, the method includes the step of sliding the central movable component along the first direction away from the first barrier in the third arrangement using the at least one motor. The method also includes the step of sliding the central movable component along the first direction toward the second barrier in the second arrangement using the at least one motor. Additionally, the method includes the step of sliding the central movable component along the first direction away from the second barrier in the third arrangement using the at least one motor.

In some embodiments, the first tube and the second tube both attach to a connector and combine into an outflow tube exiting the connector. The at least one pinch member includes a movable portion of the connector that is movable relative to the front face. The power actuator includes a motor operably coupled to the movable portion of the connector. Therefore, the method further includes the step of moving the movable portion of the connector to pinch closed the first tube in the first arrangement. The method also includes the step of moving the movable portion of the connector to pinch closed the second tube in the second arrangement. Additionally, the method includes the step of moving the movable portion of the connector to pinch closed neither the first tube nor the second tube in the third arrangement.

BRIEF DESCRIPTION OF THE DRAWINGS

For a detailed description of example embodiments, reference will now be made to the accompanying drawings in which.

DEFINITIONS

Figure 1:
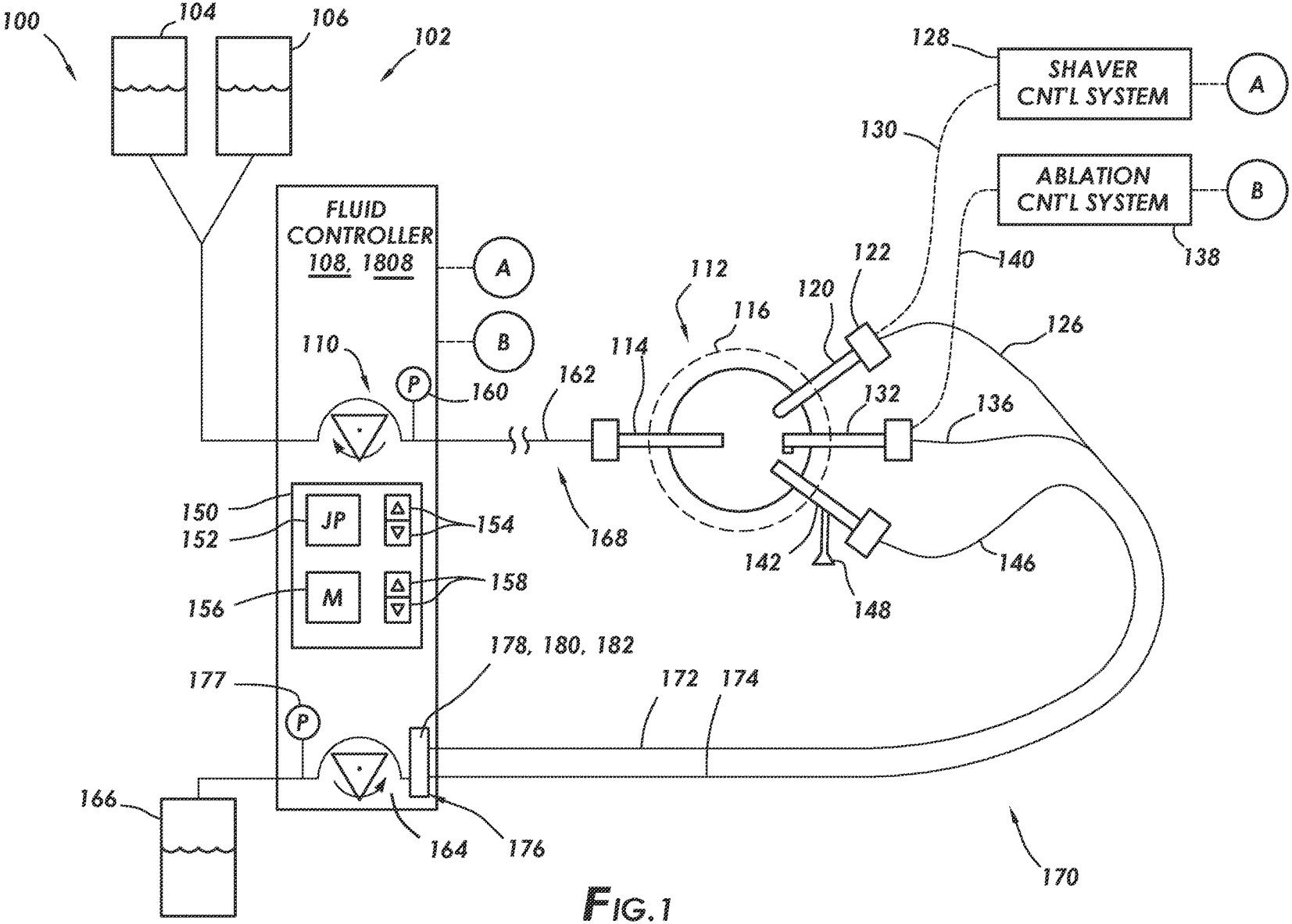
FIG. 1 shows a surgical system including a pump system with a pinch valve mechanism in accordance with at least some embodiments.

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

"Control system" shall comprise, singly or in combination, a field programmable gate array (FPGA), application specific integrated circuit (ASIC), programmable logic device (PLD), programmable logic controller (PLC), microcontroller, specifically implemented processor-based system, configured to read electrical signals and take control actions responsive to such signals.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various embodiments are directed to fluid management during surgical procedures, such as arthroscopic procedures. More particularly, example embodiments are directed to pump systems or fluid controllers including an outflow pump. The outflow pump couples to a surgical site by way of tubes which are also connected to a cannula or other surgical devices to provide an outflow of surgical fluid from a surgical site. The fluid controller can also include an inflow pump utilized along with the outflow pump to provide a continuous fluid flow through the surgical site. Outflow from the surgical site can occur from multiple sources (e.g., the cannula or other surgical devices). The tubes utilized for outflow can include a first tube and a second tube. Depending on the device in use, the pump system can control the outflow from a particular one of the surgical devices at any given time by closing one of the first and second tubes and opening the other of the of the first and second tubes. Thus, the pump system can include a pinch valve movable between multiple positions or orientations to pinch closed the first and second tubes. The specification first turns to a brief description of why having a pump system with a pinch valve having three distinct positions or orientations may provide a competitive advantage in the marketplace.

Related-art pump systems are available from a variety of manufacturers. In most cases, the related-art pump systems employ pinch valves with only two positions or orientations that are either pinching closed the first tube or the second tube at any given time (i.e., a two-position pinch valve). However, such two-position pinch valves present challenges when the first and second tubes are loaded onto the outflow pump during an initial setup of the pump system for a surgical procedure. If, for example, the two-position pinch valve is in a first position for pinching closed the first tube, the second tube may be loaded during the initial setup. Next, the two-position pinch valve must be commanded to toggle (e.g., using a button, lever) to the second position for pinching closed the second tube while the first tube is loaded to complete the initial setup. Similarly, after the surgical procedure is completed, the two-position pinch valve must be commanded to toggle between the first and second positions in order to remove the first and second tube from the pump system.

Embodiments of pump systems utilizing a pinch valve mechanism having three distinct positions or orientations are discussed herein. Specifically, the pinch valve mechanisms described include at least one tube support that aligns and supports the first and second tubes and at least one pinch member that may be moved relative to the at least one tube support using a power actuator operably coupled to the at least one pinch member. In more detail, the power actuator is configured to have three orientations that define: a first arrangement of the at least one pinch member relative to the at least one tube support configured to pinch closed the first tube, a second arrangement of the at least one pinch member relative to the at least one tube support configured to pinch closed the second tube, and a third arrangement of the at least one pinch member relative to the at least one tube support configured to pinch closed neither the first tube nor the second tube. The specification now turns to an example system.

FIG. 1 shows a surgical system 100 in accordance with at least some embodiments. In particular, FIG. 1 shows a source of surgical fluid 102 in the form of saline bags 104 and 106. The example source of surgical fluid 102 fluidly couples to a fluid controller 108 comprising a first positive displacement pump 110 or inflow pump, the positive displacement pump illustratively shown as a peristaltic pump (and hereafter just first peristaltic pump 110). The suction inlet of the first peristaltic pump 110 is coupled to saline bags 104 and 106, and its discharge is fluidly coupled to the surgical site 112. In example systems, the surgical fluid is provided to the surgical site 112 by an instrument in the form of inflow cannula 114 having an internal channel fluidly coupled to the surgical site 112. The pressure of fluid within the surgical site may distend the surgical site slightly, such as shown by the dashed line 116 around the surgical site 112. The amount of distention will vary with pressure as well as the rigidity of the tissue surrounding the surgical site. The surgical site may be, for example, a knee, a shoulder, a hip, an ankle, or a wrist of the patient.

The example surgical system 100 further comprises a plurality of instruments associated with the surgical site 112 out which fluid may flow; however, various embodiments are applicable to any situation in which surgical fluid flows from the surgical site 112, including surgical fluid flowing directly out an incision through the skin of the patient. The example surgical system 100 comprises a first instrument in the form of a mechanical resection device 120, such as a blade, burr device, or "shaver." So as not to unduly complicate the disclosure, the mechanical resection device 120 will be referred to as shaver 120 with the understanding that any mechanical resection device may be used. The shaver 120 may comprise a tubular member that defines an internal channel in communication with a distal opening, and a mechanical blade in operational relationship to the distal opening. The mechanical blade may be turned or oscillated by a motor (e.g., a motor within handle 122). The shaver 120 may be fluidly coupled to a source of suction (e.g., wall suction in a surgical room, a peristaltic pump, or other vacuum pump) by way of tube 126, and may be electrically coupled to a shaver control system 128 by way of an electrical connection 130 (electrical connection shown in dashed lines in FIG. 1 to avoid confusion with tubular connections). In operation, the shaver control system 128 provides electrical energy to the motor in the handle 122, which motor oscillates or turns the mechanical blade at the distal tip. The mechanical blade and distal opening may be placed proximate to tissue to be removed or resected, and the mechanical blade motion may cut the tissue and thereby create tissue fragments. Moreover, the tissue fragments and fluid within the joint may be drawn through the channel inside the shaver 120 by tube 126. In some example systems, the shaver control system 128 may be electrically coupled (shown by bubble "A") to the fluid controller 108 such that the fluid controller 108 can proactively respond to activation of the shaver 120 (discussed more below).

Another example instrument that may be used is an ablation device. In particular, the example surgical system 100 further comprises an ablation device 132. The ablation device 132 may comprise a tubular member that defines an internal channel in communication with a distal opening, and a metallic electrode in operational relationship to the distal opening and disposed within the surgical site 112. The ablation device 132 may be fluidly coupled to a source of suction (e.g., wall suction in a surgical room, or a peristaltic pump) by way of tube 136, and may be electrically coupled to an ablation control system 138 by way of an electrical connection 140 (shown with a dashed line). In operation, the ablation control system 138 provides electrical energy to the metallic electrode, which creates plasma near the metallic electrode. The metallic electrode and distal opening may be placed proximate to tissue to be removed or resected, and the plasma may volumetrically reduce and/or disassociate the tissue, creating tissue fragments and ablation by-products. Moreover, the tissue fragments, ablation by-products, and surgical fluid within the surgical site may be drawn through the channel inside the ablation device 132 by way of tubing 136. In some example systems, the ablation control system 138 may be electrically coupled (shown by bubble "B") to the fluid controller 108 such that the fluid controller 108 can proactively respond to activation of the ablation device 132 (discussed more below).

Continuing to refer to FIG. 1, another example instrument that may be used is an outflow cannula 142. The outflow cannula 142 may comprise a tubular member that defines an internal channel in communication with a distal opening, and disposed within the surgical site 112. The outflow cannula may fluidly couple to a source of suction (e.g., wall suction in a surgical room, or a peristaltic pump) by way of tube 146. Thus, the outflow cannula 142 may be used to ensure fluid flow through surgical site 112. Although there are many alternatives to the surgical system 100 of FIG. 1, in some cases the outflow cannula 142 may also comprise optics for visualizing the inside of the surgical site, the optics illustrated by eyepiece 148 associated with the outflow cannula 142. In other example systems, the optics may be associated with the inflow cannula 114, and the outflow cannula 142 may be omitted or, if used, not have optics for visualization. In yet still other cases, inflow and outflow may be through a single cannula (with the inflow and outflow channels separated).

Still referring to FIG. 1, and returning to the fluid controller 108, the example fluid controller 108 further comprises a user interface 150 visible on or through an exterior surface of the fluid controller 108. The user interface 150 may take any suitable form, such as a display device (e.g., liquid crystal display (LCD)) with touch screen capabilities, or individually implement buttons and devices to display values. In the example system, the user interface 150 is designed and constructed to accept a setpoint joint pressure, as shown by setpoint joint pressure window 152 and buttons 154. Thus, by interfacing with the buttons 154 the surgeon may select a setpoint joint pressure as shown in the setpoint joint pressure window 152. Further in example embodiments, the user interface 150 is designed and constructed to accept an indication of a mode of operation of the fluid controller, as shown by mode window 156 and buttons 158. Thus, by interfacing with the buttons 158 the surgeon may select a mode (e.g., aggressive mode, conservative mode) as shown in the mode window 156. The fluid controller 108 may be configured to calculate or infer a joint pressure based on a pressure of surgical fluid measured at the outlet of the peristaltic pump 110 (as measured by pressure sensor 160) and pressure drop across the tube 162 and inflow cannula 114.

The fluid controller 108 additionally includes a second positive displacement pump 164 or outflow pump configured to provide suction or aspiration to the surgical site 112. Thus, the fluid controller 108 may be known as a dual flow pump system 108 or simply pump system 108. The second positive displacement pump 164 is illustratively shown as a peristaltic pump (and hereafter just second peristaltic pump 164). The suction inlet of the second peristaltic pump 164 is coupled to the shaver 120, ablation device 132, and/or outflow cannula 142 and its discharge is fluidly coupled to a waste receptacle 166. Accordingly, the pump system 108 is designed to use two tube sets 168, 170 during operation, an inflow tube set 168 including the tube 162 and an outflow tube set 170 for connection to the shaver 120, ablation device 132, and/or outflow cannula 142. In more detail, the outflow tube set 170 splits into two lumens or channels (i.e., a first tube 172 and a second tube 174) such that two surgical instruments (e.g., the shaver 120, ablation device 132, and/or outflow cannula 142) may be used, one at a time, within the surgical site 112 using the second peristaltic pump 164.

Before proceeding, it is noted that while it is theoretically possible to have both a shaver 120 and ablation device 132 inserted into the surgical site 112 at the same time, in many cases only one such instrument will be used, or will be used at any given time, and thus it is possible that a single entry point through the patient's skin into the surgical site 112 may be created and used for both the example classes of instruments. The instrument the surgeon chooses to use may be inserted into the entry point, used within the surgical site 112, and then withdrawn such that the second instrument can be inserted and used. Furthermore, while tube 136 and tube 126 are both shown connected together, it should be understood that in cases where both shaver 120 and ablation device 132 are used at the same time, only one would likely be connected to the second tube 174 at a time and either the shaver 120 or ablation device 132 would likely be connected to a separate source of suction (e.g., wall suction in a surgical room) other than the second peristaltic pump 164. Alternatively, the outflow tube set 170 may include more than two tubes 172, 174 (e.g., an nth tube for use with whichever of the shaver 120 or ablation device 132 that is not connected to the second tube 174).

The pump system 108 further includes the pinch valve mechanism 176 and will be electronically informed regarding which instrument 120, 132 is in use (e.g., via analog signals indicative of activation of the surgical instruments 120, 132 from the shaver control system 128 or the ablation control system 138 and/or based on a pressure of surgical fluid measured at the outlet of the second peristaltic pump 164 as measured by a pressure sensor 177), and will actuate the pinch valve mechanism 176 to close off or pinch the tubing of the surgical instrument 120, 132 not in use and only enable outflow through the outflow cannula. For example, when the shaver 120 or ablation device 132 is in use, the first tube 172 for the outflow cannula 142 may be pinched closed, and when use of the shaver 120 or ablation device 132 is discontinued, the second tube 174 for the shaver 120 or ablation device 132 may be pinched closed while the first tube 168 for the outflow cannula 142 is opened to flow. As will be discussed in more detail below, the pinch valve mechanism 176 includes at least one tube support 178, at least one pinch member 180 movable relative to the at least one tube support 178, and a power actuator 182 operably coupled to the at least one pinch member 180 and configured to move the at least one pinch member 180 relative to the at least one tube support 178 to selectively pinch either the first tube 172 or the second tube 174.

Figure 2:
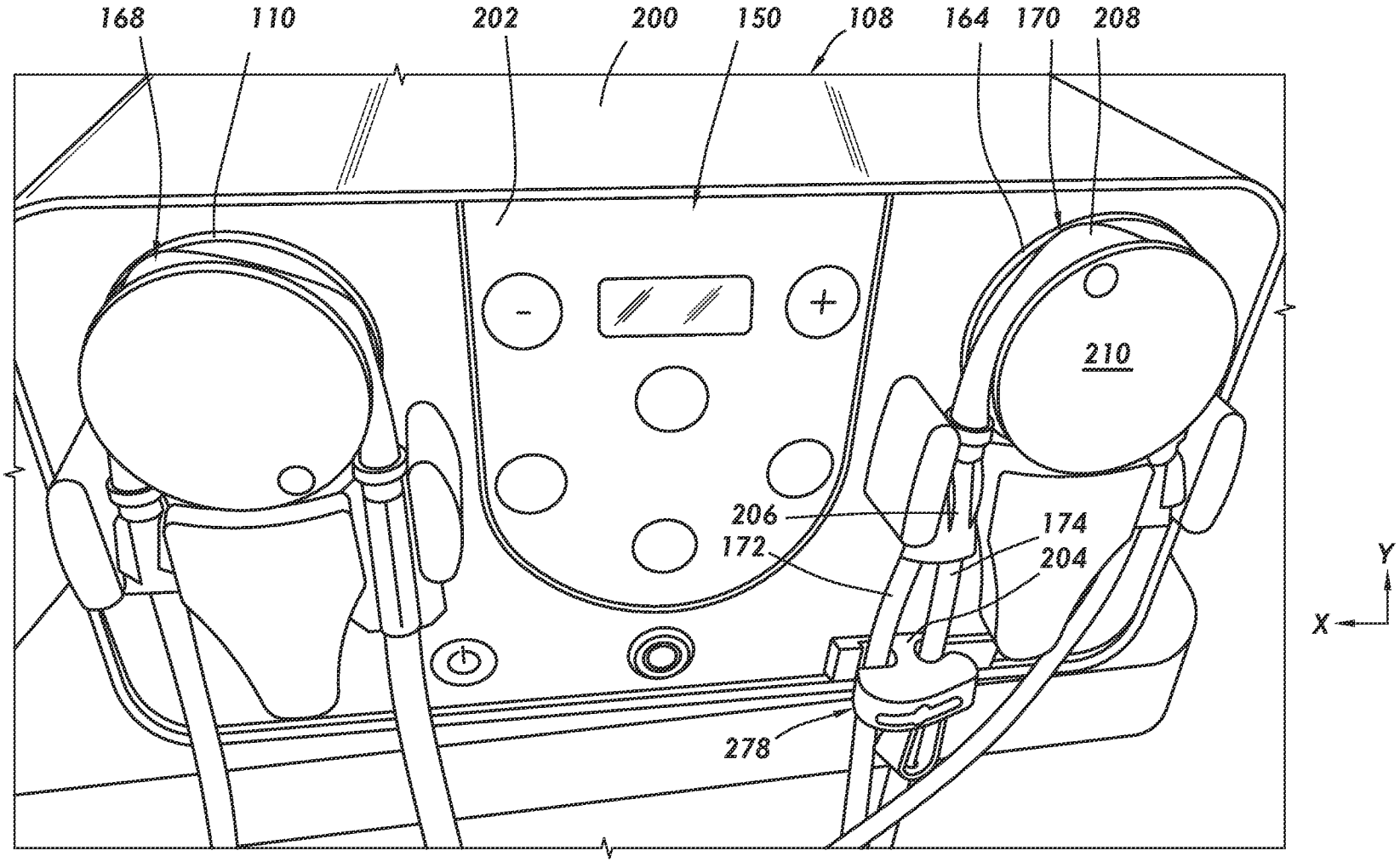
FIG. 2 shows the pump system with an example of the pinch valve mechanism in accordance with at least some embodiments.

FIG. 2 shows the pump system 108 in accordance with at least some embodiments. As shown, the pump system 108 includes a stationary housing 200 defining an internal volume and a front face 202 or front panel outside the internal volume extending in a first direction Y and a second direction X transverse to the first direction Y. The tube set on the left is the inflow tube set 168 used in conjunction with the first peristaltic pump 110, while the tube set on the right is the outflow tube set 170 including the first tube 172 and the second tube 174 used in conjunction with the second peristaltic pump 164. The stationary housing 200 includes an example of the at least one tube support 178, the example in the form of tube support 278 outside the internal volume extending outwardly from the front face 202 for aligning and supporting the first tube 172 and the second tube 174. As shown, the first tube 172 and the second tube 174 each extend along one another, along the front face 202 of the stationary housing 200, and in a spaced relationship with one another to define a tubing gap 204 therebetween. The first tube 172 and the second tube 174 both attach to a connector 206 and combine into an outflow tube 208 exiting the connector 206. The outflow tube 208 wraps around a rotor 210 of the second peristaltic pump 164. Nevertheless, other configurations of the first tube 172 and the second tube 174 are contemplated.

Referring simultaneously to FIGS. 1 and 2, the power actuator 182 may be disposed in the internal volume and is configured to have three orientations that define: 1) a first arrangement of the at least one pinch member 180 relative to the at least one tube support 178 configured to pinch closed the first tube 172, 2) a second arrangement of the at least one pinch member 180 relative to the at least one tube support 178 configured to pinch closed the second tube 174, and 3) a third arrangement of the at least one pinch member 180 relative to the at least one tube support 178 configured to pinch closed neither the first tube 172 nor the second tube 174. In more detail, the third arrangement is a neutral position in which neither the first tube 172 nor the second tube 174 are pinched. Consequently, the first and second tubes 172, 174 and outflow tube 208 may be loaded (e.g., onto the rotor 210 of the second peristaltic pump 164) during the initial setup for the surgical procedure without requiring any intervention, such as commanding the toggling of the pinch valve mechanism 176 as in known prior art systems. Also, the first and second tubes 172, 174 may advantageously be removed from the second peristaltic pump 164 without commanding the toggling of the pinch valve mechanism 176 (i.e., as soon as the second peristaltic pump 164 stops, the power actuator 182 is configured to move to the third arrangement automatically). While the power actuator 182 is discussed as being inside the internal volume of the stationary housing 200, it should be understood that the power actuator 182 may instead be disposed outside the stationary housing 200 in some embodiments.

Figure 3:
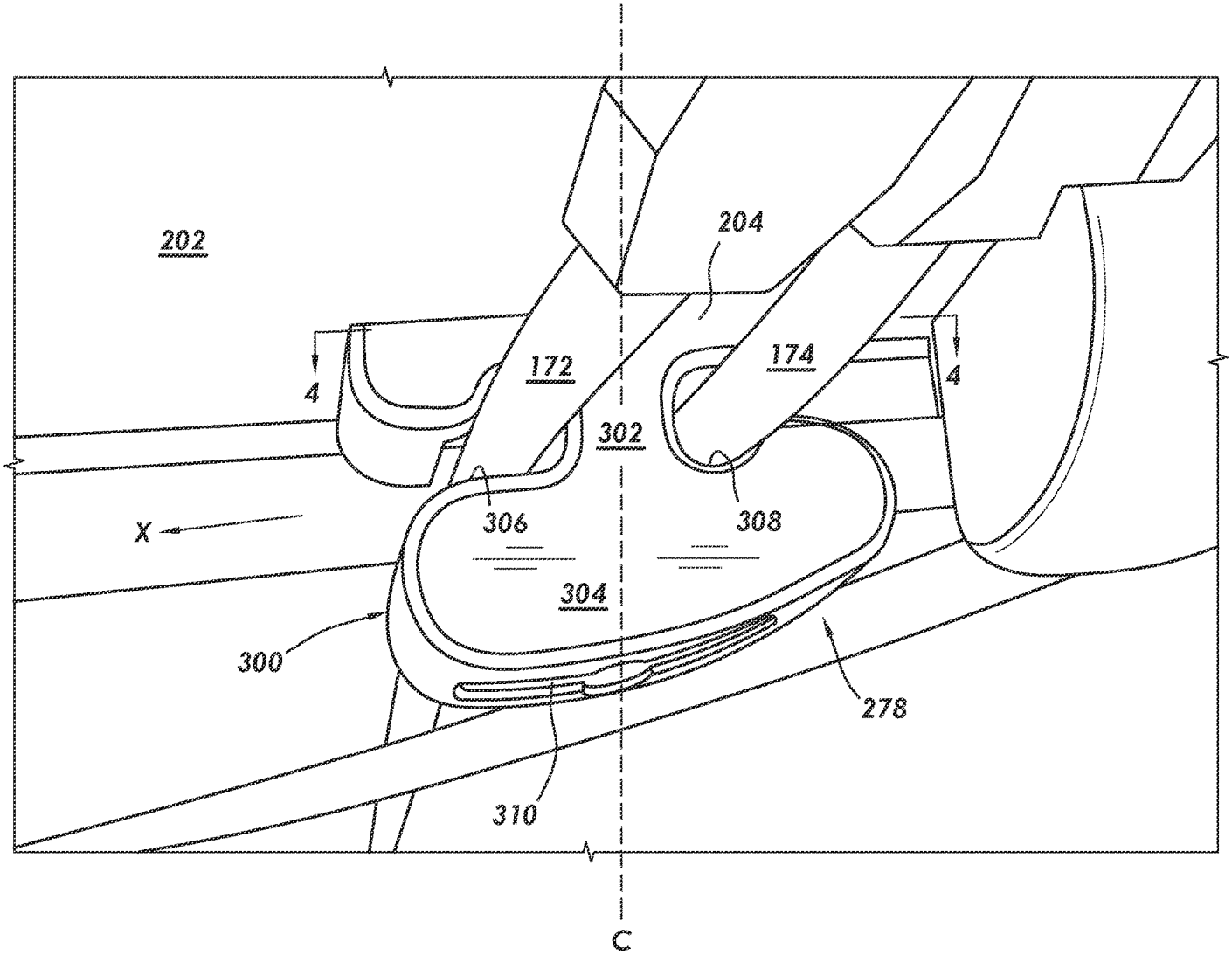
FIG. 3 shows at least one tube support of the example of the pinch valve mechanism in accordance with at least some embodiments.

FIG. 3 shows the tube support 278 of an example of the pinch valve mechanism 176 in accordance with at least some embodiments. So, referring simultaneously to FIGS. 2 and 3, the tube support 278 includes a t-shaped bracket 300 having a central post 302 extending outwardly from the front face 202 along a longitudinal central axis C. Specifically, the central post 302 extends along the longitudinal central axis C through the tubing gap 204. The t-shaped bracket 300 includes a support beam 304 attached to and extending across the central post 302 and spaced from and along the front face 202 in the second direction X. Because the support beam 304 extends across the first tube 172 and the second tube 174, the likelihood of inadvertent removal of the first and second tubes 172, 174 from the second peristaltic pump 164 can be reduced. The t-shaped bracket 300 defines a first tube notch 306 configured to accept the first tube 172 and a second tube notch 308 configured to accept the second tube 174. The t-shaped bracket 300 also defines a bracket cavity 310 leading to the internal volume and extending through the central post 302 and into the support beam 304.

Figure 4:
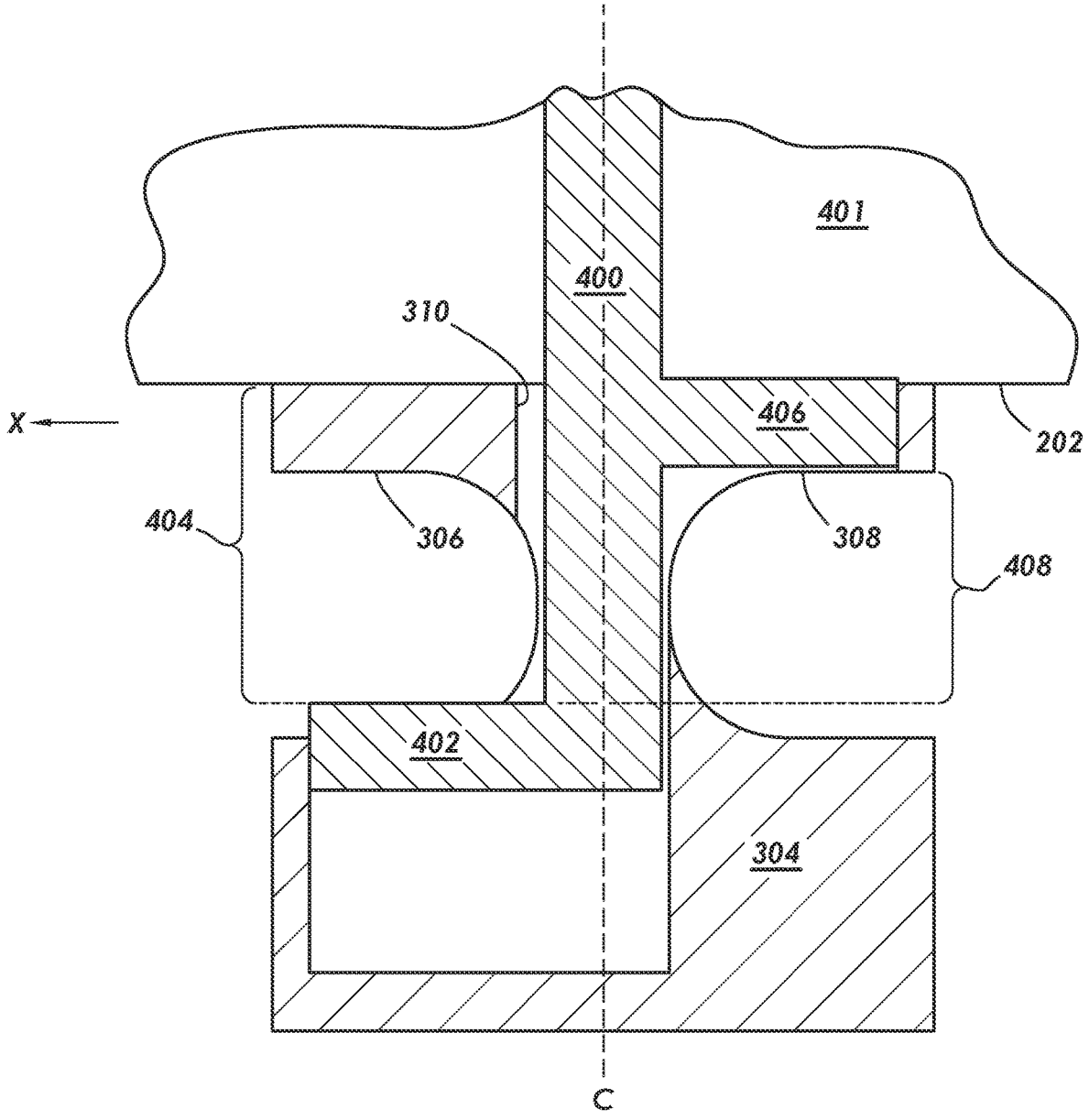
FIG. 4 is a cross-sectional overhead view of at least one pinch member of the example of the pinch valve mechanism taken through the section illustrated in FIG. 3 in accordance with at least some embodiments.

FIG. 4 shows the at least one pinch member of an example of the pinch valve mechanism in accordance with at least some embodiments. Specifically, the power actuator 182 (FIG. 1) includes a sliding shaft 400 extending along the longitudinal central axis C through the front face 202 and out of the internal volume 401 of the stationary housing 200 into the bracket cavity 310. The sliding shaft 400 is shown in a third translational position in FIG. 4. The at least one pinch member 180 (FIG. 1) includes a first pinch bar 402 extending radially from the longitudinal central axis C at a distal end of the sliding shaft 400 in a first lateral direction (i.e., along the second direction X). Thus, the first pinch bar 402 extends along the support beam 304 into the bracket cavity 310 adjacent the first tube notch 306. The first pinch bar 402 is configured to move toward the front face 202 when the sliding shaft 400 is moved to a first translational position. The first pinch bar 402 is also configured to maintain spacing of a first notch width 404 with the front face 202 when the sliding shaft 400 moves to the third translational position. Thus, the first pinch bar 402 pulls the first tube 172 toward the front face 202 as the sliding shaft 400 moves (e.g., approximately 20 millimeters) from a second or a third translational position to the first translational position. The at least one pinch member 180 (FIG. 1) also includes a second pinch bar 406 extending radially from the longitudinal central axis C in a second lateral direction opposite the first lateral direction (i.e., along the second direction X) into the bracket cavity 310. The second pinch bar 406 is offset from the first pinch bar 402 along the longitudinal central axis C by a second notch width 408. The second pinch bar 406 extends along and is spaced from the support beam 304. The second pinch bar 406 is configured to move away the front face 202 (e.g., approximately 20 millimeters) when the sliding shaft 400 is moved to the second translational position. The second pinch bar 406 is also configured to maintain spacing of the second notch width 408 with the front face 202 when the sliding shaft 400 moves to the third translational position. So, the second pinch bar 406 pushes the second tube 174 toward the support beam 304 as the sliding shaft 400 moves from the third translational position to the second translational position; however, the second pinch bar 406 does not interfere with the second tube 174 when the sliding shaft 400 is in the third translational position. While the at least one pinch member 180 is shown with the first and second pinch bars 402, 406 being offset along the longitudinal central axis C, it should be appreciated that instead of the first and second tubes 172, 174 extending along one another and both roughly equally spaced from the front face 202, the first and second tubes 172, 174 could be offset along the longitudinal central axis C while the first and second pinch bars 402, 406 are not offset along the longitudinal central axis C (see e.g., FIGS. 10A-10C). In other words, any offset employed to allow the three orientations or arrangements discussed above can be provided by offset tubes 172, 174, offset pinch bars 402, 406, or a combination of both offset tubes 172, 174 and offset pinch bars 402, 406, for example.

Figure 5:
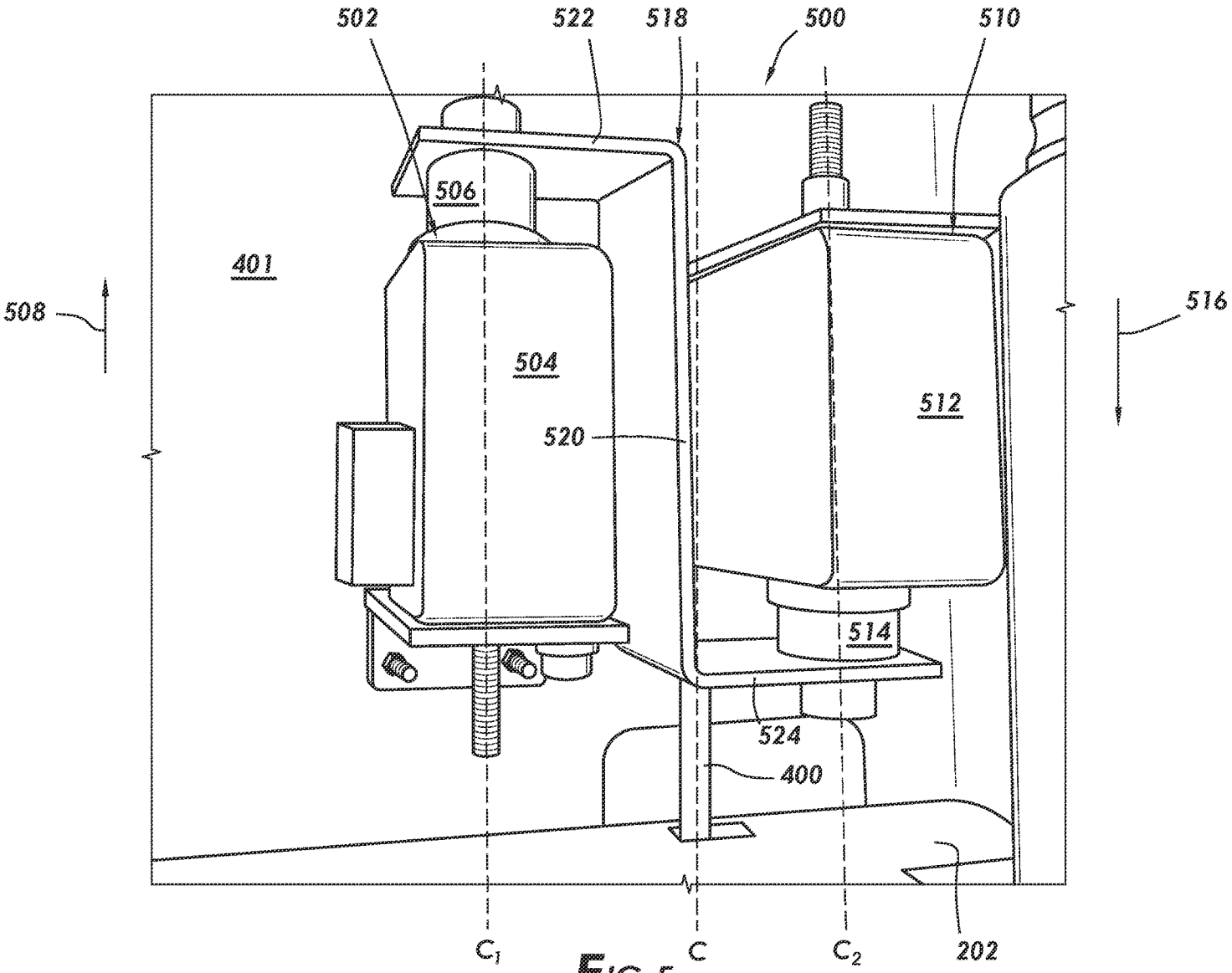
FIGS. 5 and 6 illustrate a power actuator of the example of the pinch valve mechanism in accordance with at least some embodiments.
Figure 6:
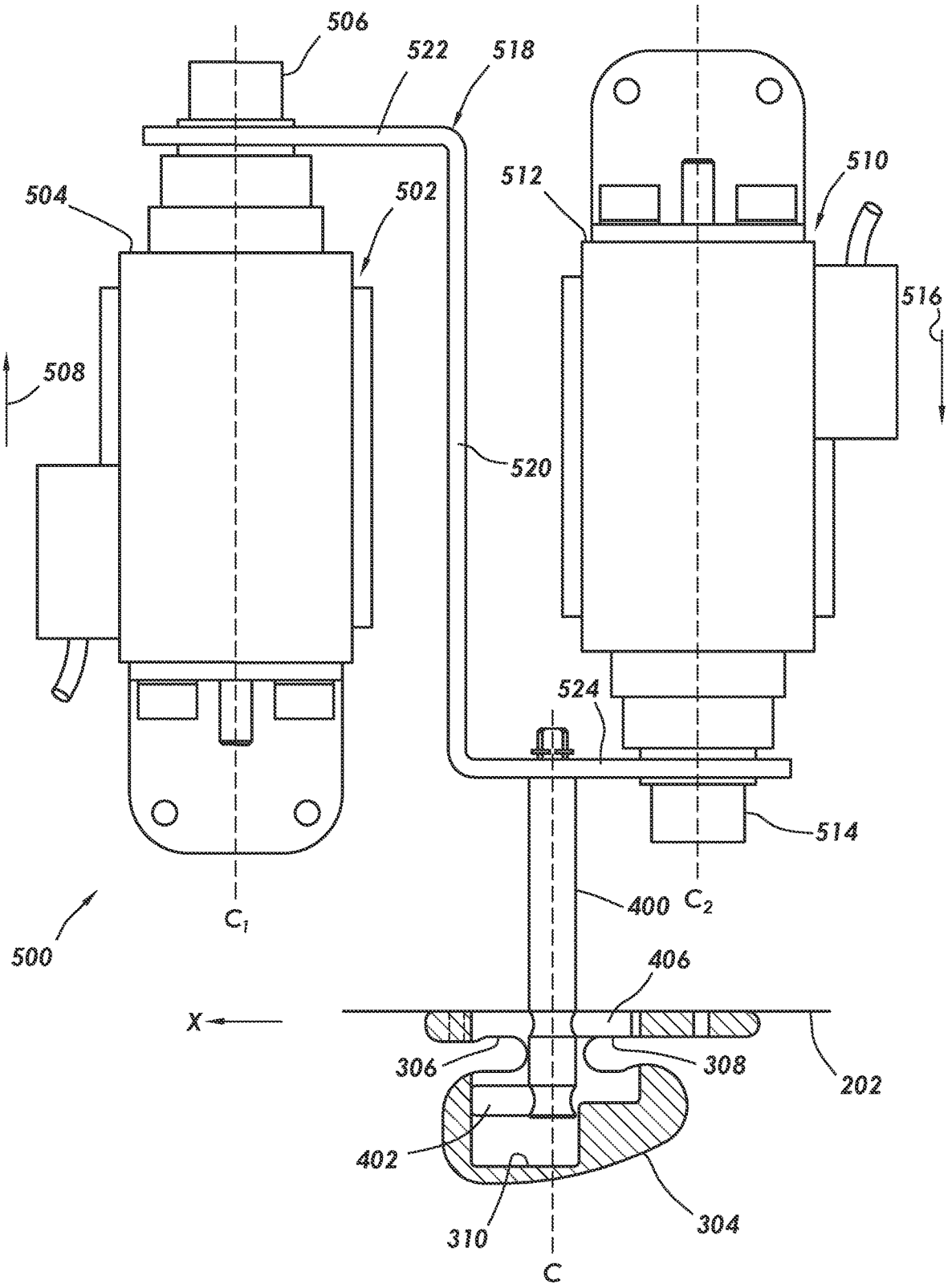

FIGS. 5 and 6 illustrate the power actuator of an example of the pinch valve mechanism in accordance with at least some embodiments. Specifically, the power actuator 182 (FIG. 1) includes a solenoid assembly 500 disposed in the internal volume 401 that is coupled to the sliding shaft 400. The sliding shaft 400 is movable by the solenoid assembly 500 along the longitudinal central axis C to: a first translational position to move the at least one pinch member 180 (FIG. 1) to the first arrangement, a second translational position to move the at least one pinch member 180 to the second arrangement, and a third translational position to move the at least one pinch member 180 to the third arrangement.

In more detail, the solenoid assembly 500 includes a first solenoid 502 having a first coil 504 fixedly attached to the stationary housing 200 and a first solenoid core 506 extending and movable along a first core axis $C_1$ in parallel to the longitudinal central axis C. The first solenoid 502 is configured to move the first solenoid core 506 in a first core direction 508 along the first core axis $C_1$. Specifically, the first solenoid core 506 moves from a first core initial position corresponding to the third translational position of the sliding shaft 400 to a first core extended position corresponding to the first translational position of the sliding shaft 400 in response to the first coil 504 being energized. The first solenoid core 506 returns to the first core initial position in response to the first coil 504 not being energized (e.g., using a spring of the first solenoid 502).

The solenoid assembly 500 also includes a second solenoid 510 having a second coil 512 fixedly attached to the stationary housing 200 and a second solenoid core 514 extending and movable along a second core axis $C_2$ in parallel to the longitudinal central axis C and spaced from the first core axis $C_1$. The second solenoid 510 is configured to move the second solenoid core 514 in a second core direction 516 along the second core axis $C_2$ opposite the first core direction 508. More specifically, the second solenoid core 514 moves from a second core initial position corresponding to the third translational position of the sliding shaft 400 to a second core extended position corresponding to the second translational position of the sliding shaft 400 in response to the second coil 512 being energized. The second solenoid core 514 returns to the second core initial position in response to the second coil 512 not being energized (e.g., using a spring of the second solenoid 510).

In addition, the solenoid assembly 500 includes a z-shaped bracket 518 for moving the sliding shaft 400 along the longitudinal central axis C. The z-shaped bracket 518 includes a central portion 520 extending rectilinearly in parallel to the longitudinal central axis C. The z-shaped bracket 518 includes a first arm 522 extending orthogonally to the longitudinal central axis C that attaches to the first solenoid core 506 and the sliding shaft 400. The z-shaped bracket 518 additionally includes a second arm 524 extending orthogonally to the longitudinal central axis C that attaches to the second solenoid core 514.

Figure 7:
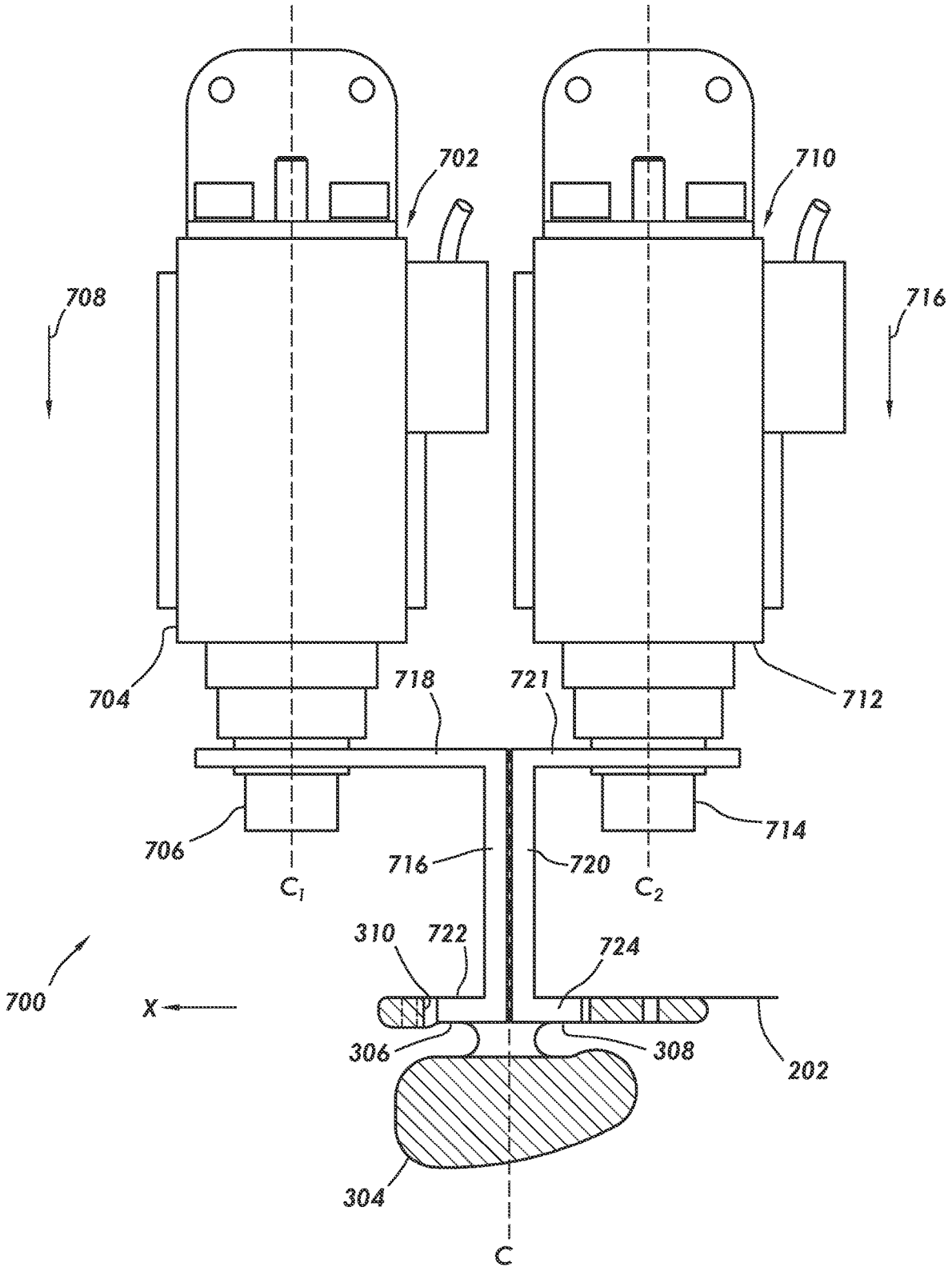
FIG. 7 illustrates another power actuator of another example of the pinch valve mechanism in accordance with at least some embodiments.

FIG. 7 illustrates another power actuator of an example of the pinch valve mechanism in accordance with at least some embodiments. Similar to solenoid assembly 500 of FIGS. 5 and 6, solenoid assembly 700 includes a first solenoid 702 and a second solenoid 710. While the second solenoid 510 in FIGS. 5 and 6 is configured to move the second solenoid core 514 in the second core direction 516 along the second core axis $C_2$ opposite the first core direction 508, the second solenoid assembly 710 shown in FIG. 7 is configured to move second solenoid core 714 along the second core axis $C_2$ in the second core direction 716 being in the same direction as the first core direction 708 (i.e., both the first core direction 708 and the second core direction 716 are not in opposite directions and are instead in the same direction). Again, the first solenoid core 706 moves from a first core initial position (shown in FIG. 7) to a first core extended position in response to the first coil 704 being energized. The first solenoid core 706 returns to the first core initial position in response to the first coil 704 not being energized. Similarly, the second solenoid core 714 moves from a second core initial position (shown in FIG. 7) to a second core extended position in response to the second coil 712 being energized. The second solenoid core 714 returns to the second core initial position in response to the second coil 712 not being energized.

Instead of the z-shaped bracket 518 shown in FIGS. 5 and 6 coupled to the sliding shaft 400, a first shaft half 716 is coupled to the first solenoid core 706 by a first bracket half 718 extending transverse to the first core axis $C_1$ from the first solenoid core 706 toward the longitudinal central axis C and a second shaft half 720 coupled to the second solenoid core 714 by a second bracket half 721 extending transverse to the second core axis $C_2$ from the second solenoid core 714 toward the longitudinal central axis C. Both the first shaft half 716 and the second shaft half 720 move normal to the front face 202. The at least one pinch member 180 (FIG. 1) includes a first half pinch bar 722 extending radially from the longitudinal central axis C (i.e., along the second direction X) at a distal end of the first shaft half 716 in a first lateral direction along the support beam 304 into the bracket cavity 310 adjacent the first tube notch 306. The first half pinch bar 722 is configured to move away the front face 202 when the first shaft half 716 is in a primary first shaft half position (corresponding to sliding shaft 400 being in the first translational position) while maintaining spacing of a first notch width 704 with the support beam 304 when the first shaft half 716 is in a tertiary first shaft half position (shown in FIG. 7 and corresponding to the sliding shaft 400 being in the third translational position). The at least one pinch member 180 (FIG. 1) also includes a second half pinch bar 724 extending radially from the longitudinal central axis C in a second lateral direction opposite the first lateral direction (i.e., along the second direction X) into the bracket cavity 310. The second half pinch bar 724 is configured to move away the front face 202 when the second shaft half 720 is in a primary second shaft half position (corresponding to the sliding shaft 400 being in the second translational position) while maintaining spacing of the second notch width 708 with the front face 202 when the second shaft half 720 is in a tertiary second shaft half position (shown in FIG. 7 and corresponding to the sliding shaft 400 being in the third translational position). So, instead of the pinch bars 722, 724 being offset along the longitudinal central axis C like in FIGS. 5 and 6, the first half pinch bar 722 and the second half pinch bar 724 are not offset along the longitudinal central axis C when the first shaft half 716 is in the tertiary first shaft half position and the second shaft half 720 is in the tertiary second shaft half position.

Figure 8:
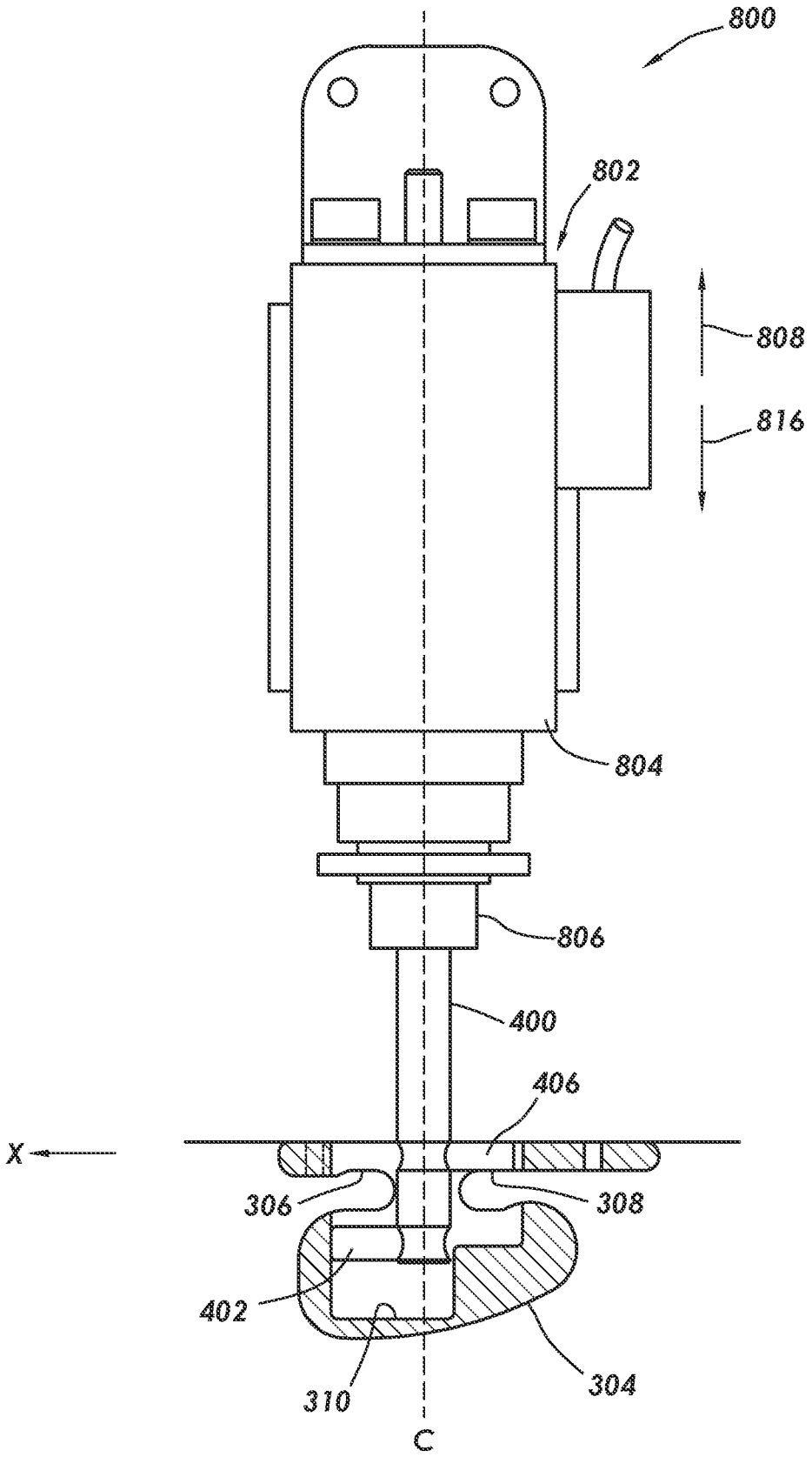
FIG. 8 illustrates another power actuator of another example of the pinch valve mechanism in accordance with at least some embodiments.

FIG. 8 illustrates another power actuator of an example of the pinch valve mechanism in accordance with at least some embodiments. Unlike the solenoid assemblies 500, 700 shown in FIGS. 5-6 and FIG. 7, the solenoid assembly 800 only includes one two-way solenoid 802 (i.e., a two-way, bidirectional, or push/pull type solenoid) that has a single two-way solenoid coil 804 and a single solenoid core 806 that is movable along the longitudinal central axis C. Specifically, the single solenoid core 806 is movable in a first two-way direction 808, a second two-way direction 816, or remains in a third neutral position (corresponding to the sliding shaft 400 being in the third translational position) depending on whether the single two-way solenoid coil 804 is energized with a positive voltage or a negative voltage. So, the third neutral position corresponds to the third arrangement discussed above (e.g., and the single solenoid core 806 may be held in place by one or more springs). The single solenoid core 806 directly attaches to the sliding shaft 400 (no bracket as in FIGS. 5-7).

While up until this point, the power actuator 182 (FIG. 1) has been discussed as the solenoid assembly 500, 700, 800, it should be appreciated that the power actuator 182 may instead be any other mechanism that moves the sliding shaft 400 along the longitudinal central axis C such as, but not limited to a linear actuator (e.g., a motor driven linear actuator). Such a linear actuator could, for example, also include an encoder to provide feedback based on the rotations of the motor driving the linear actuator. Both the solenoid assembly 500, 700, 800 and the linear actuator enable the sliding shaft 400 to move normal to the front face 202.

Figure 9:
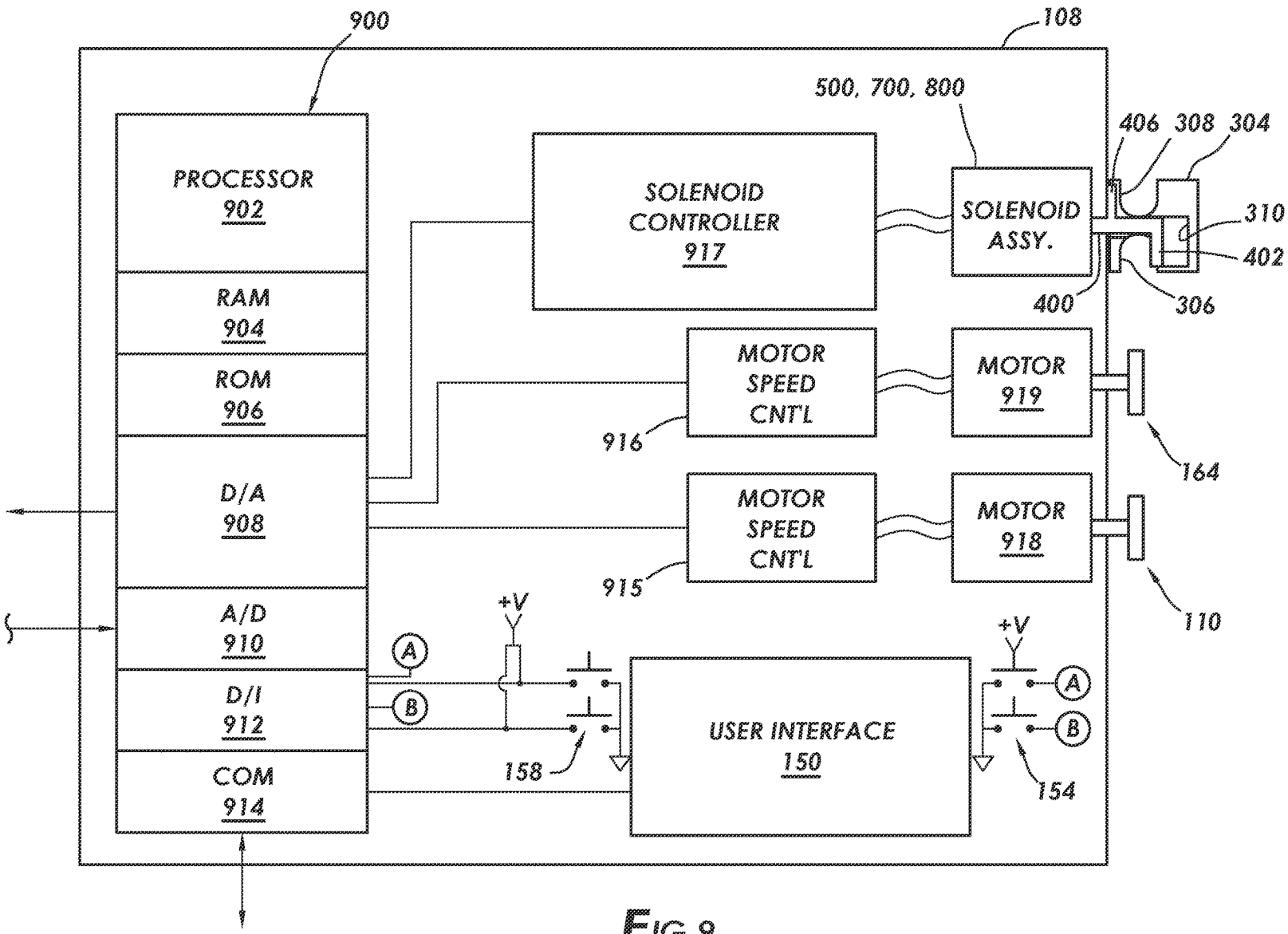
FIG. 9 shows, in block diagram form, an example of the pump system in accordance with at least some embodiments.

FIG. 9 shows, in block diagram form, an example fluid controller or pump system 108 in accordance with at least some embodiments. In particular, the example fluid controller 108 has a control system 900 coupled to various internal and external components. In the example system of FIG. 9, the control system 900 takes the example form of a microcontroller having processor 902 electrically coupled to random access memory (RAM) 904, read-only memory (ROM) 906, digital-to-analog (D/A) outputs 908, analog-to-digital (A/D) inputs 910, digital inputs (D/I) 912, as well as communication logic (COM) 914 sections. Though control system 900 is shown in the form of a microcontroller, in other cases individual components (i.e., an individual processor, RAM, ROM, etc.) may be combined to implement the functionality, or other devices such as FGPAs, ASICs, PLCs, and discrete components may be used. The example RAM 904 may be the working memory for the processor 902. ROM 906 may store programs and data in a non-volatile fashion, and the processor 902 may copy the programs and data from the ROM 906 to RAM 904 during execution of the programs. The digital-to-analog outputs 908 may be used to provide analog signals to other devices within the fluid management system, such as a first motor speed controller 915, second motor speed controller 916, and/or a solenoid controller 917 (both discussed more below), or to external devices (e.g., a separate inflow pump controller, if used). The analog-to-digital inputs 910 may provide the control system 900 the ability to read analog signals, such as pressure measurements from the pressure sensors 160, 176, or analog signals indicative of activation of various surgical instruments and their respective outflows (e.g., from the shaver control system 128 or the ablation control system 138). The digital inputs 912 may be used to receive information into the control system 900, such as digital signals indicative of activation of various surgical instruments (e.g., from the shaver control system 128 or the ablation control system 138), or information from example push buttons 154 and 158 (discussed more below). Finally, the communication logic 914 may be used for packet-based communications with internal or external devices (e.g., a system that has indications of activity of surgical instruments, user interface 150).

Regardless of the mechanism by which the fluid controller 108 receives various pieces of information, the control system 900 may implement various modes of operation related to pumping surgical fluid to the surgical site 112 by commanding first peristaltic pump 110 to operate, removing surgical fluid from the surgical site 112 by commanding second peristaltic pump 164 using the motor speed controller 916, and/or commanding the movement of the at least one pinch member 180 (e.g., the first and second pinch bars 402, 406 or first half pinch bar 722 and second half pinch bar 724) by the power actuator 182 (e.g., the solenoid assembly 500, 800 and sliding shaft 400 or solenoid assembly 700 and first shaft half 716 and second shaft half 720) using the solenoid controller 917.

As shown, the first peristaltic pump 110 is turned by motor 918 and the second peristaltic pump 164 is turned by motor 919. The motors 918, 919 may take any suitable form. For example, the motors 918, 919 may be direct current (DC) electric motor, and thus the motor speed controllers 915, 916 provides a DC voltage to the electric motors 918, 919 which controls the speed of the output shafts. In other cases, the motors 918, 919 may be alternating current (AC) electric motors, and thus the motor speed controllers 915, 916 provide an AC voltage at varying voltage and frequency which controls the speed of the output shafts. In yet still other cases, the motors 918, 919 may be a pneumatic motor, and thus the motor speed controllers 915, 916 provide air at varying pressures, where the pressure controls the speed of the output shafts. Thus, regardless of the type of motors 918, 919 implemented, the motor speed controllers 915, 916 control the speed of the motors 918, 919 responsive to commands provided from the control system 900. While in the example system, the command to the motor speed controllers 915, 916 can be an analog signal, in other cases the motor speed controllers 915, 916 may receive commands in packet-based messages (e.g., through the communication logic 914). Finally, while the motors 918, 919 are respectively shown to directly couple to the first peristaltic pump 110 and second peristaltic pump 164, in other cases various gears and/or belts may be used to transfer the rotational motion of the shaft of motors 918, 919 to first peristaltic pump 110 and second peristaltic pump 164, respectively. While FIG. 9 is based on having rotary peristaltic pumps 110, 164, one having ordinary skill and with the benefit of this disclosure could modify the system to be used with other types of outflow pumps, such as linear peristaltic pumps or centrifugal pumps combined with flow measurement devices (as the flow rate through a centrifugal pumps may not be as directly related to speed as is a positive displacement pump (such as a peristaltic pump)).

The solenoid controller 917 additionally controls the movement of the solenoid assembly 500, 700, 800 responsive to commands provided from the control system 900. Though in the example system the command to the solenoid controller 917 can be an analog signal, in other cases the solenoid controller 917 may receive commands in packet-based messages (e.g., through the communication logic 914).

In typical surgical procedures, for example, it is common that outflow cannula 142 is used for a comparatively longer period of time (e.g., used for 95% of an overall time of the surgical procedure) as compared to the shaver 120 or ablation device 132 (e.g., used for 5% of the overall time of the surgical procedure). Accordingly, the second tube 174 may be pinched closed longer than the first tube 172. In addition, the tubes 172, 174 take a natural set after a period of time after they are initially pinched (e.g., approximately 5 seconds). Thus, the tubes 172, 174 do not require the same pinch force to be sustained after this period of time in order to maintain the tubes 172, 174 being pinched or closed off. Specifically, it has been observed that the pinch force required to fully pinch the first tube 172 or second tube 174 is relatively higher initially. Once the occlusion of the tube 172, 174 is established, this pinch force may be reduced while still maintaining the occlusion of the tube 172, 174. Consequently, the solenoid controller 917 coupled to the solenoid assembly 500, 700, 800 is configured to reduce a voltage supplied to the solenoid assembly 500, 700, 800 from an initial voltage (e.g., 24 volts) to a predetermined reduced voltage (e.g., 11 volts) after a predetermined amount of time (e.g., approximately 15-20 seconds). So, an amount of power required to maintain a pinch applied by the at least one pinch member 180 (e.g., pinch force of 20 pounds to the first tube 172) in the first translational position of the sliding shaft 400 (or the first shaft half 716 being in the primary first shaft half position) is reduced. Likewise, an amount of power required to maintain a pinch applied by the at least one pinch member 180 (e.g., pinch force of 20 pounds to the second tube 174) in the second translational position of the sliding shaft 400 (or the second shaft half 720 being in the primary second shaft half position) is reduced due to the reduction of the voltage supplied to the solenoid assembly 500, 700, 800 after the predetermined amount of time. Because the outflow cannula 142 may be used for a comparatively longer period of time as compared to the shaver 120 or ablation device 132, power consumed by the solenoid assembly 500, 700, 800 can be advantageously be reduced by the solenoid controller 917 being configured in this way. It should be understood that such a reduction in the voltage supplied to the solenoid assembly 500, 700, 800 could be carried out in many different ways, such as, but not limited to adjusting a duty cycle of a pulse width modulated voltage provided to the solenoid assembly 500, 700, 800.

Before proceeding, it is noted that the embodiment of FIG. 9 show the first and second peristaltic pumps 110, 164 and solenoid assembly 500, 700, 800 as internal devices to the fluid controller 108; however, in other cases the first and second peristaltic pumps 110, 164 and solenoid assembly 500, 700, 800 may be external components to the fluid controller 108.

Thus, in example embodiments where the control system 900 is a processor 902, RAM 904, etc., as shown, the ROM 906 and RAM 904 (and possibly other non-transitory storage mediums) store instructions that implement the control of the first and second peristaltic pumps 110, 164 as well as the pinch valve mechanism 176 (FIG. 1). For example, the instructions, when executed by the processor 902, may cause the processor 902 to move the power actuator 182 (FIG. 1) between the three orientations that define: the first arrangement of the at least one pinch member 180 (FIG. 1) relative to the at least one tube support 178 (FIG. 1) configured to pinch closed the first tube 172; the second arrangement of the at least one pinch member 180 relative to the at least one tube support 178 configured to pinch closed the second tube 174; and the third arrangement of the at least one pinch member 180 relative to the at least one tube support 178 configured to pinch closed neither the first tube 172 nor the second tube 174. In yet still other cases, the control may be, in whole or in part, implemented in an ASIC or even in discrete components (e.g., capacitors, resistors, operational amplifiers), such that the discrete components operate to control the motor speed and thus the pump speed and/or the power actuator 182.

Figure 10C:
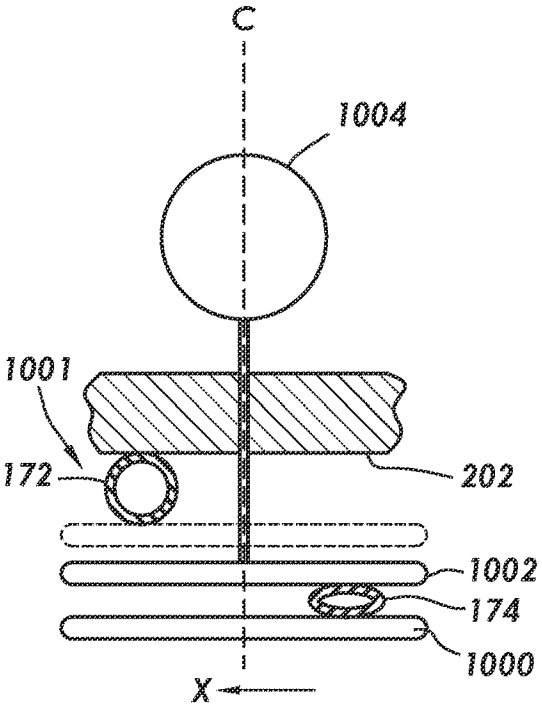
FIGS. 10B-10C are cross-sectional views of the example of the pinch valve mechanism of FIG. 10A taken through the section illustrated in FIG. 10A in accordance with at least some embodiments.
Figure 10B:
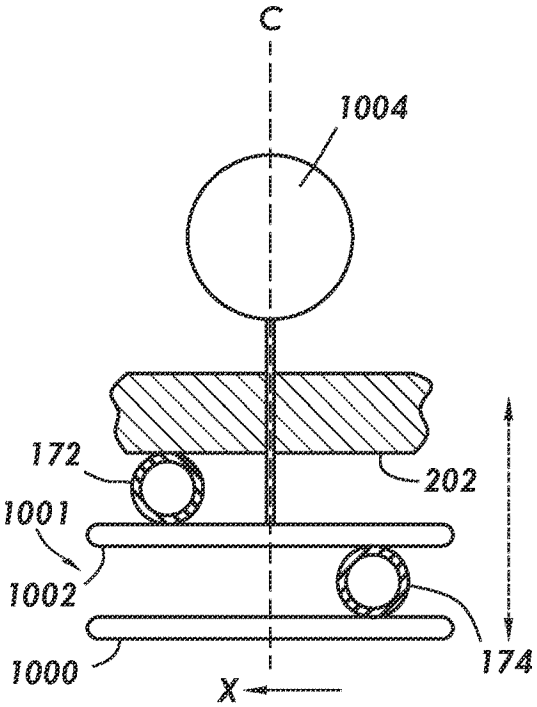
Figure 10A:
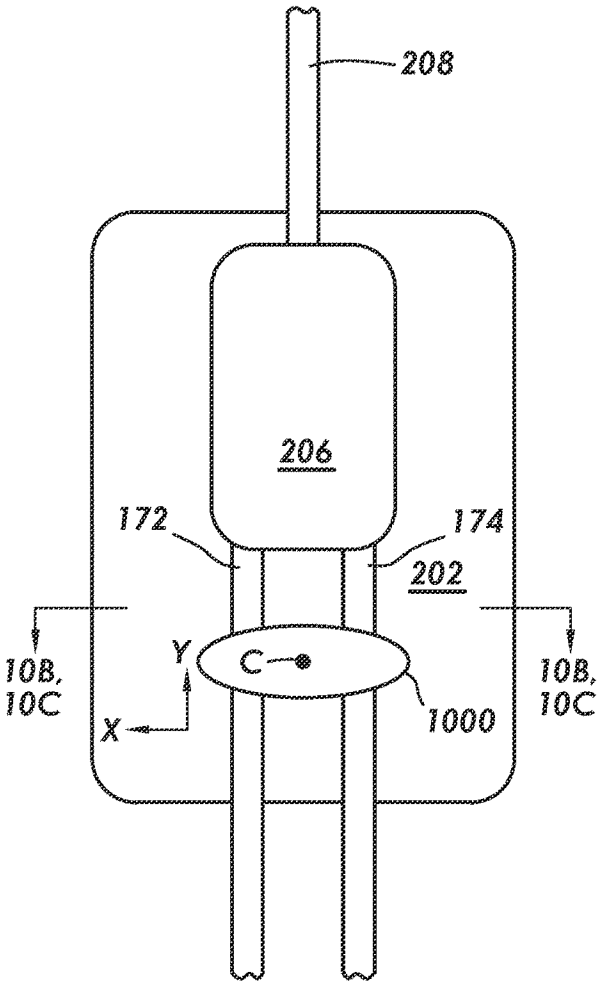
FIG. 10A shows another example of the pinch valve mechanism in accordance with at least some embodiments.

Another example of the pinch valve mechanism in accordance with at least some embodiments is shown in FIGS. 10A-10C. The at least one tube support 178 (FIG. 1) includes a fixed part 1000 that extends along and is spaced from the front face 202 of the stationary housing 200 in the second direction X to define a tube pocket 1001 therebetween. As in the embodiments shown in FIGS. 2-9, the at least one pinch member 180 (FIG. 1) is movable relative to the at least one tube support 178. However, instead of the first and second pinch bars 402, 406 being offset along the longitudinal central axis C, as shown in FIG. 4, for example, the at least one pinch member 180 includes a single pinch bar 1002 that extends rectilinearly along the front face 202 of the stationary housing 200 in the second direction X between the front face 202 and the fixed part 1000. Instead of the first and second tubes 172, 174 extending along one another and both roughly equally spaced from the front face 202 as shown in FIG. 2, the first and second tubes 172, 174 are offset along the longitudinal central axis C. In addition, instead of the power actuator 182 (FIG. 1) being the solenoid assembly 500, 700, 800, a motor 1004 (e.g., a stepper motor) is coupled to the single pinch bar 1002 for moving the single pinch bar 1002 toward or away from the front face 202. FIG. 10B shows the single pinch bar 1002 being in a neutral position in which neither the first tube 172 nor the second tube 174 are being pinched. FIG. 10C instead shows the pinch bar in a third position in which the second tube 174 is pinched as the single pinch bar 1002 moves away from the front face 202 and the first tube 172 is not pinched. While not shown, the single pinch bar 1002 can also move to a second position in which the first tube 172 is pinched as the single pinch bar 1002 moves toward the front face 202 and the second tube 174 is not pinched.

Referring now to FIGS. 11A-11C and 12A-12B, which show alternative examples of the pinch valve mechanism 176 in accordance with at least some embodiments, the at least one tube support 178 (FIG. 1) includes a first barrier 1100, 1200 extending outwardly from the front face 202 and having a first barrier edge 1102, 1202 extending along the first direction Y for facing the first tube 172. The at least one tube support also includes a second barrier 1104, 1204 extending outwardly from the front face 202 opposite and spaced from the first barrier 1100, 1200 and having a second barrier edge 1106, 1206 extending along the first direction Y for facing the second tube 174. The at least one pinch member 180 (FIG. 1) includes a central movable component 1108, 1208 extending outwardly from the front face 202 between the first barrier 1100 and the second barrier. More specifically, the central movable component 1108 extends outwardly from the front face 202 between the first tube 172 and the second tube 174 through the tubing gap 204. The central movable component 1108, 1208 is selectively spaced from the first barrier 1100, 1200 and the second barrier 1104, 1204 and is movable toward one of the first barrier 1100, 1200 and the second barrier 1104, 1204. The power actuator 182 (FIG. 1) includes at least one motor 1004 operably coupled to the central movable component 1108, 1208. The at least one motor 1004 is configured to move the central movable component 1108, 1208 toward the first barrier edge 1102, 1202 of the first barrier 1100, 1200 to pinch the first tube 172 against the first barrier edge 1102, 1202 of the first barrier 1100, 1200 in the first arrangement. The at least one motor 1004 is also configured to move the central movable component 1108, 1208 away from the first barrier edge 1102, 1202 of the first barrier 1100, 1200 to release the first tube 172 in the third arrangement. In addition, the at least one motor 1004 is configured to move the central movable component 1108, 1208 toward the second barrier edge 1106, 1206 of the second barrier 1104, 1204 to pinch the second tube 174 against the second barrier edge 1106, 1206 of the second barrier 1104, 1204 in the second arrangement. In addition, the at least one motor 1004 is configured to move the central movable component 1108, 1208 away from the second barrier edge 1106, 1206 of the second barrier 1104, 1204 to release the second tube 174 in the third arrangement.

Figures 11A, 11B, 11C:
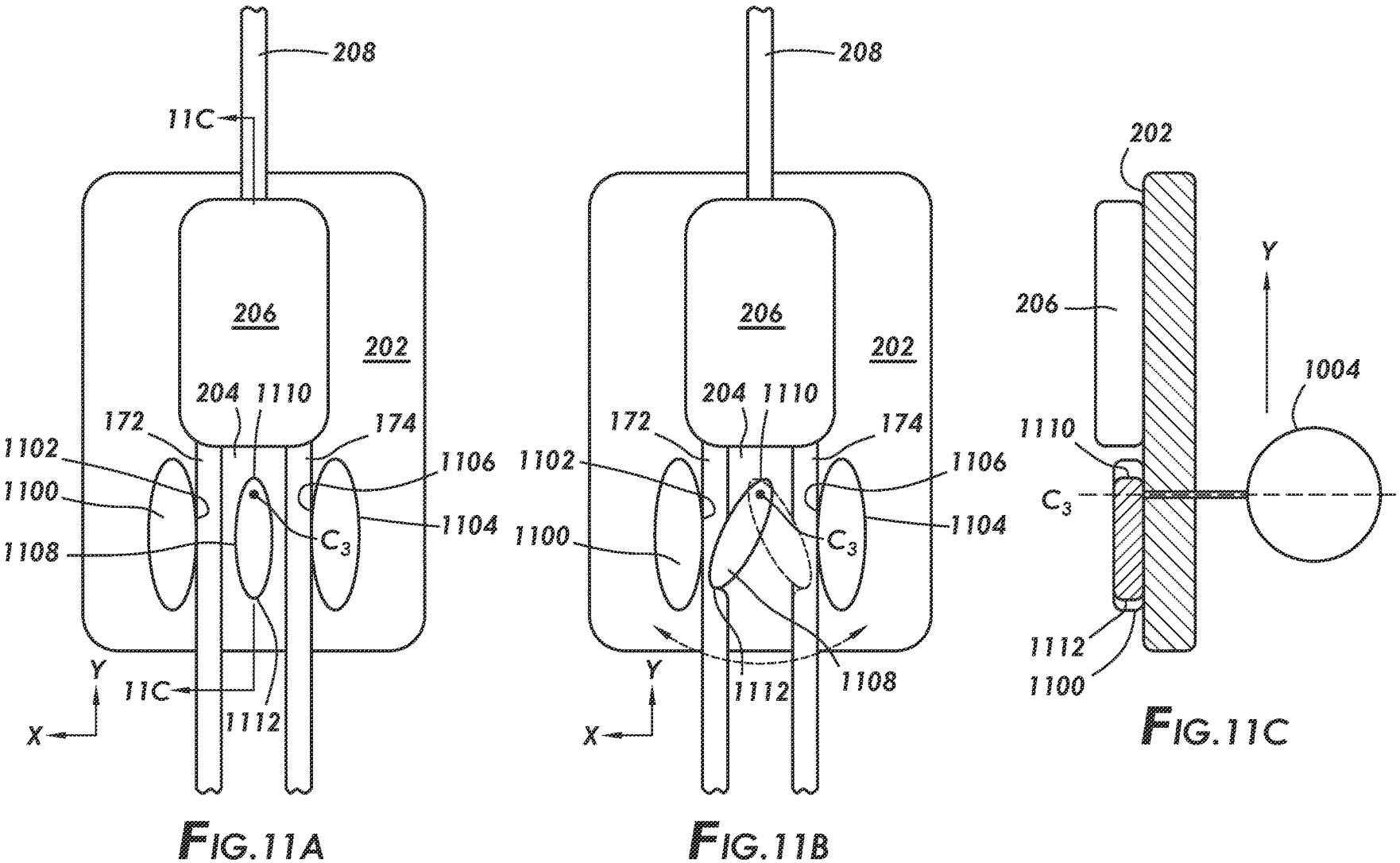
FIGS. 11A-11B show an alternative example of the pinch valve mechanism in accordance with at least some embodiments.
FIG. 11C is a cross-sectional view of a portion of the alternative example of the pinch valve mechanism of FIGS. 11A-11B taken through the section illustrated in FIG. 11A in accordance with at least some embodiments.

Specifically, referring to FIGS. 11A-11C, the first barrier edge 1102 and the second barrier edge 1106 directly face one another. The central movable component 1108 extends along the second direction X from a first central component end 1110 to a second central component end 1112. The at least one motor 1004 includes a central component shaft extending through the front face 202. The central component shaft is rotatable about a first central component end axis $C_3$ disposed at the first central component end 1110. The central component shaft connects to the first central component end 1110. The at least one motor 1004 is configured to rotate the central movable component 1108 about the first central component end axis $C_3$. In more detail, the at least one motor 1004 rotates the second central component end 1112 of the central movable component 1108 toward the first barrier edge 1102 of the first barrier 1100 to pinch the first tube 172 against the first barrier edge 1102 of the first barrier 1100 in the first arrangement. The at least one motor 1004 also rotates the second central component end 1112 of the central movable component 1108 away from the first barrier edge 1102 of the first barrier 1100 to release the first tube 172 in the third arrangement. The at least one motor 1004 also rotates the second central component end 1112 of the central movable component 1108 toward the second barrier edge 1106 of the second barrier 1104 to pinch the second tube 174 against the second barrier edge 1106 of the second barrier 1104 in the second arrangement. In addition, The at least one motor 1004 also rotates the second central component end 1112 of the central movable component 1108 away from the second barrier edge 1106 of the second barrier 1104 to release the second tube 174 in the third arrangement.

Figure 12B:
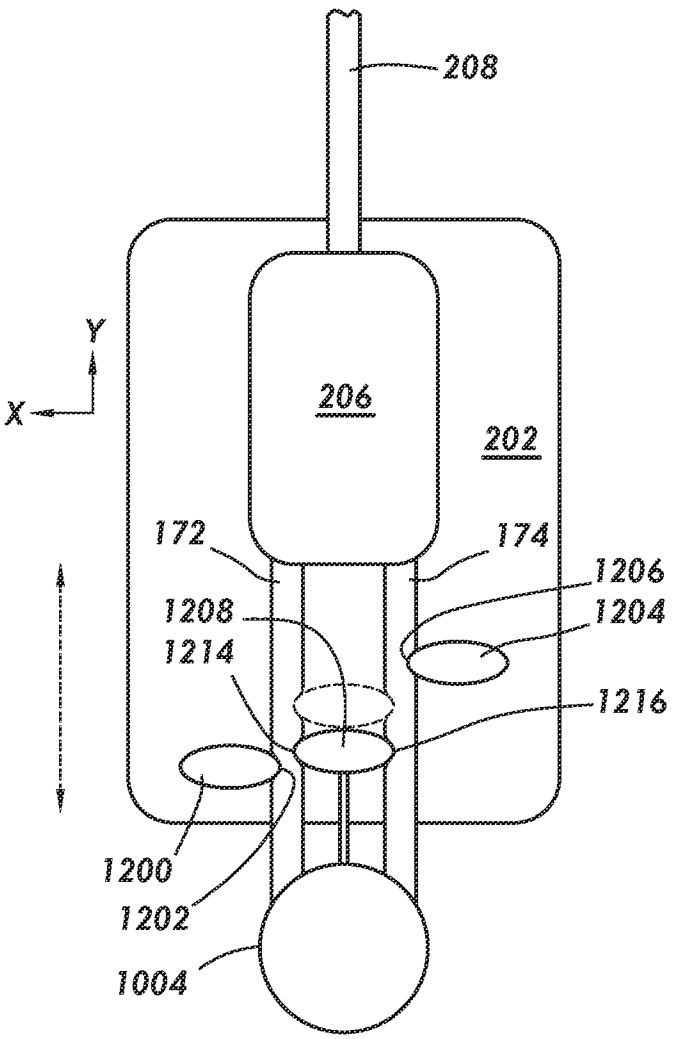
FIGS. 12A-12B show an alternative example of the pinch valve mechanism in accordance with at least some embodiments.
Figure 12A:
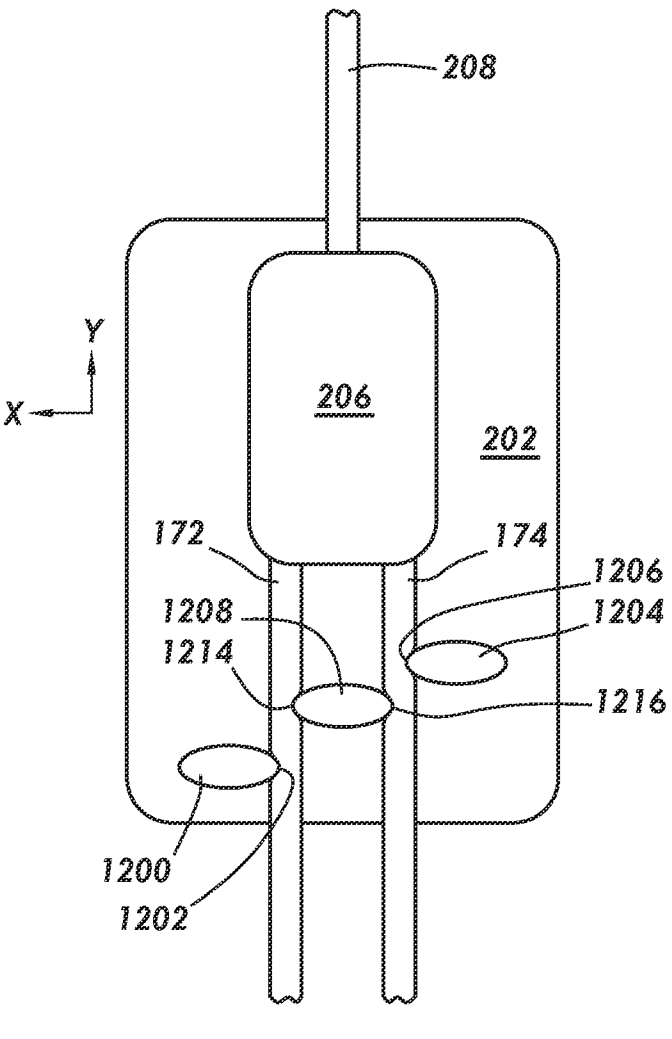

Referring to FIGS. 12A-12B, the first barrier 1200 and the second barrier 1204 are offset from one another along the first direction Y. The first barrier edge 1202 and the second barrier edge 1206 do not directly face one another and the central movable component 1208 extends in the second direction X from a first central component side 1214 to a second central component side 1216 opposite the first central component side 1214. Therefore first central component side 1214 is configured to abut the first tube 172 and the second central component side 1216 is configured to abut the second tube 174. The at least one motor 1004 is configured to move the central movable component 1208 along the second direction X. Specifically, the at least one motor 1004 slides the central movable component 1208 toward the first barrier to pinch the first tube 172 between the first central component side 1214 and the first barrier edge 1202 of the first barrier 1200 in the first arrangement. The at least one motor 1004 also slides the central movable component 1208 away from the first barrier 1200 to release the first tube 172 from between the first central component side 1214 and the first barrier edge 1202 of the first barrier 1200 in the third arrangement. The at least one motor 1004 also slides the central movable component 1208 toward the second barrier 1204 to pinch the second tube 174 between the second central component side 1216 and the second barrier edge 1206 of the second barrier 1204 in the second arrangement. In addition, the at least one motor 1004 also slides the central movable component 1208 away from the second barrier 1204 to release the second tube 174 from between the second central component side 1216 and the second barrier edge 1206 of the second barrier 1204 in the third arrangement. While the at least one motor 1004 is shown as sliding the central movable component 1208, it should be understood that a manual movement or actuation may instead be used to move or slide central movable component 1208.

Referring next to FIGS. 13A-15C, which show additional alternative examples of the pinch valve mechanism in accordance with at least some embodiments, the at least one tube support 178 (FIG. 1) includes a central barrier 1300, 1400, 1500 extending outwardly from the front face 202 and having a first central barrier side 1302, 1402, 1502 extending along the first direction Y and a second central barrier side 1304, 1404, 1504 opposite the first central barrier side 1302, 1402, 1502 extending along the first direction Y. Specifically, the central barrier 1300, 1400, 1500 extends from the front face 202 through the tubing gap 204 with the first central barrier side 1302, 1402, 1502 configured to be adjacent the first tube 172 and the second central barrier side 1304, 1404, 1504 configured to be adjacent the second tube 174. The at least one pinch member 180 (FIG. 1) includes a first movable component 1306, 1406, 1506 extending outwardly from the front face 202 and selectively spaced from the first central barrier side 1302, 1402, 1502 of the central barrier 1300, 1400, 1500. The first movable component 1306, 1406, 1506 is movable along the second direction X toward the first central barrier side 1302, 1402, 1502 of the central barrier 1300, 1400, 1500. Thus, the first movable component 1306, 1406, 1506 can pinch the first tube 172 against the first central barrier side 1302, 1402, 1502 of the central barrier 1300, 1400, 1500. In addition, the at least one pinch member 180 (FIG. 1) includes a second movable component 1308, 1408, 1508 extending outwardly from the front face 202 and selectively spaced from the second central barrier side 1304, 1404, 1504 of the central barrier 1300, 1400, 1500. The second movable component 1308, 1408, 1508 is movable along the second direction X toward the second central barrier side 1304, 1404, 1504 of the central barrier 1300, 1400, 1500. So, the second movable component 1308, 1408, 1508 can pinch the second tube 174 against the second central barrier side 1304, 1404, 1504 of the central barrier 1300, 1400, 1500. The power actuator 182 (FIG. 1) includes at least one motor 1004, 1312, 1314 operably coupled to the first movable component 1306, 1406, 1506 and the second movable component 1308, 1408, 1508. The at least one motor 1004, 1312, 1314 is configured to move the first movable component 1306, 1406, 1506 toward the first central barrier side 1302, 1402, 1502 of the central barrier 1300, 1400, 1500 to pinch the first tube 172 against the first central barrier side 1302, 1402, 1502 of the central barrier 1300, 1400, 1500 in the first arrangement. The at least one motor 1004, 1312, 1314 is also configured to move the first movable component 1306, 1406, 1506 away from the first central barrier side 1302, 1402, 1502 of the central barrier 1300, 1400, 1500 to release the first tube 172 in the third arrangement. The at least one motor 1004, 1312, 1314 is also configured to move the second movable component 1308, 1408, 1508 toward the second central barrier side 1304, 1404, 1504 of the central barrier 1300, 1400, 1500 to pinch the second tube 174 against the second central barrier side 1304, 1404, 1504 of the central barrier 1300, 1400, 1500 in the second arrangement. In addition, the at least one motor 1004, 1312, 1314 is configured to move the second movable component 1308, 1408, 1508 away from the second central barrier side 1304, 1404, 1504 of the central barrier 1300, 1400, 1500 to release the second tube 174 in the third arrangement.

Figure 13B:
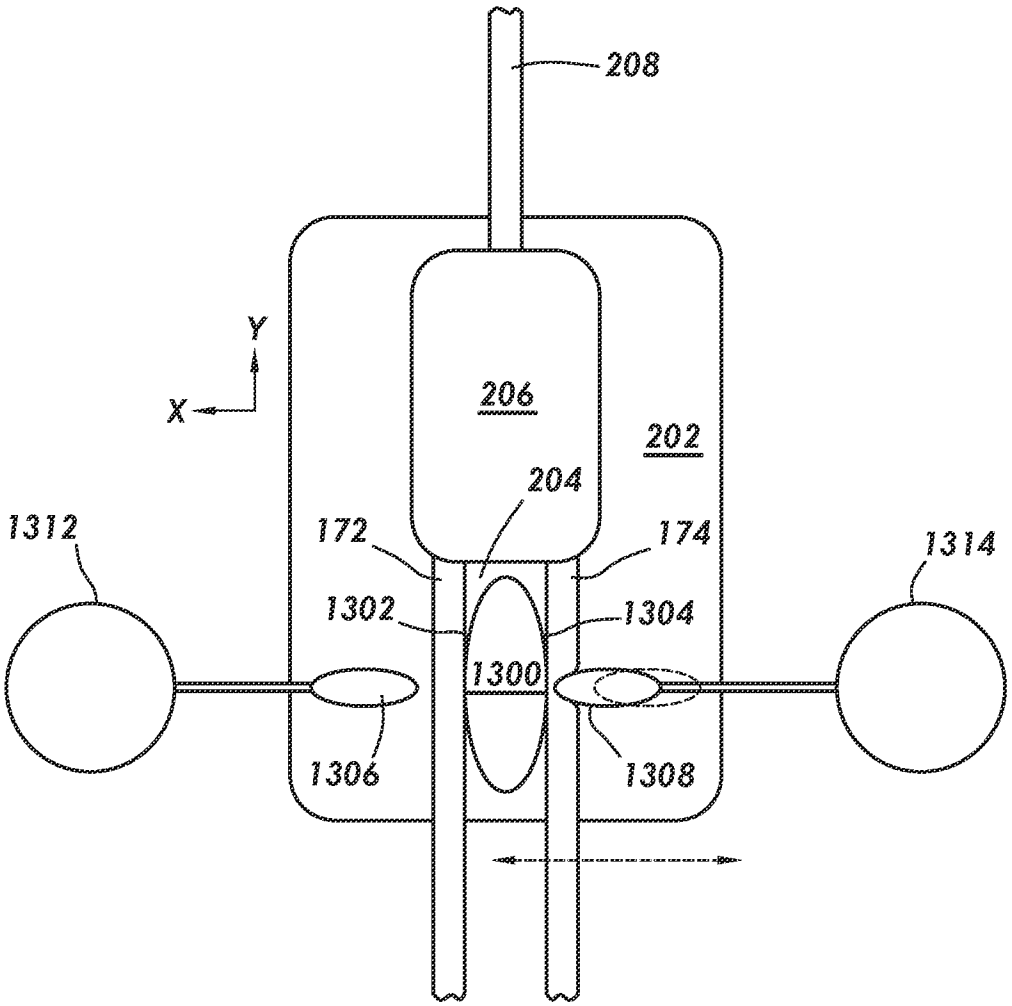
FIGS. 13A-15C show additional alternative examples of the pinch valve mechanism in accordance with at least some embodiments.
Figure 13A:
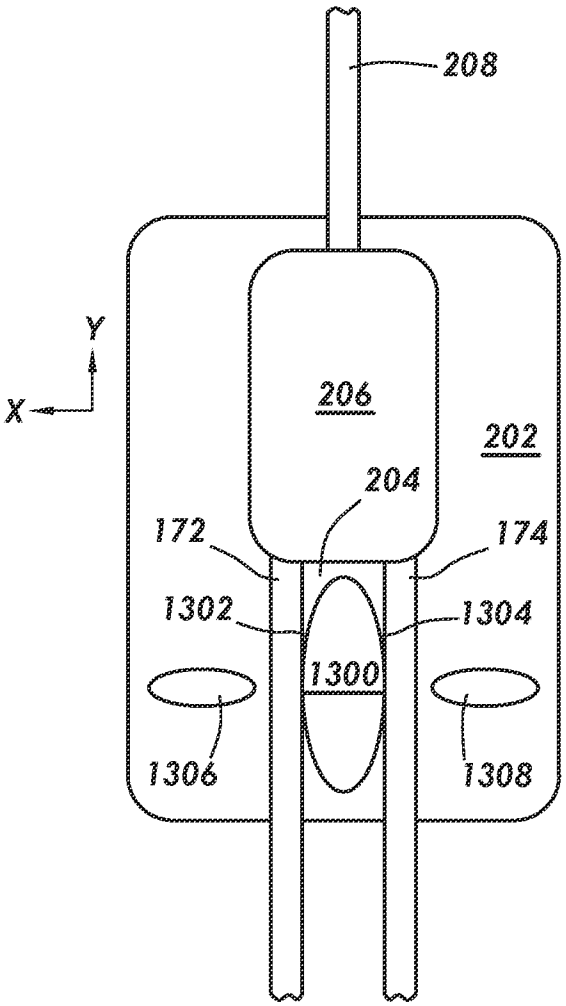
Figure 14B:
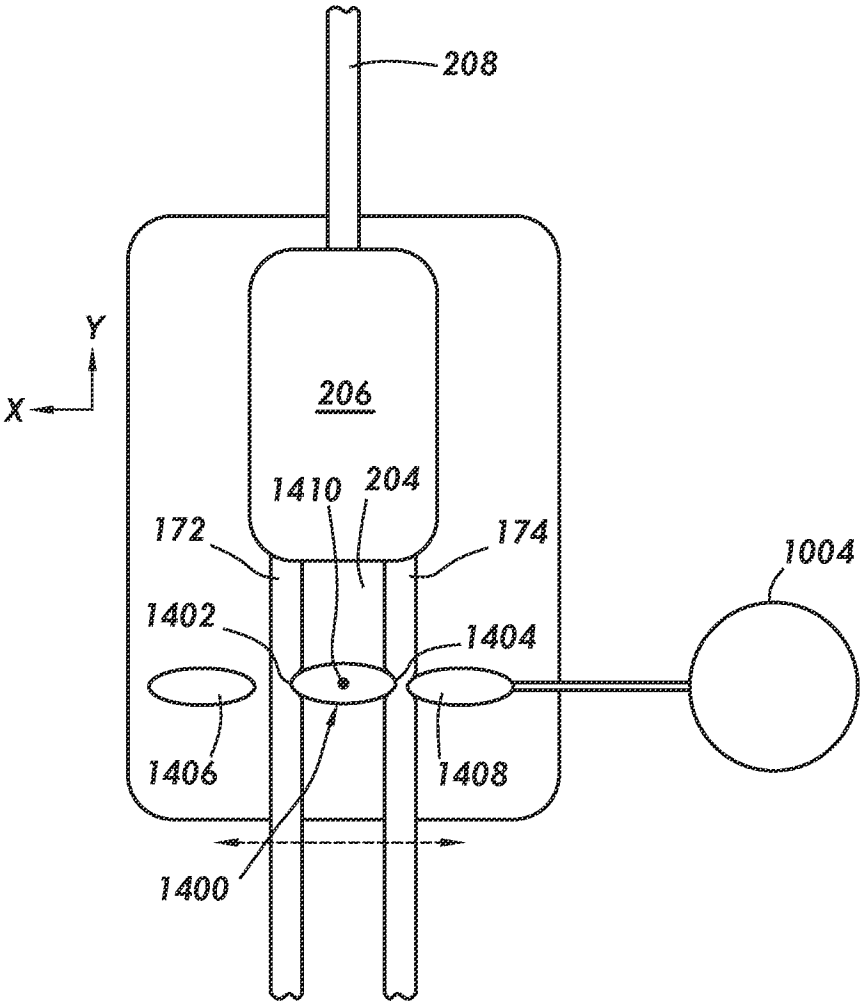
Figure 14A:
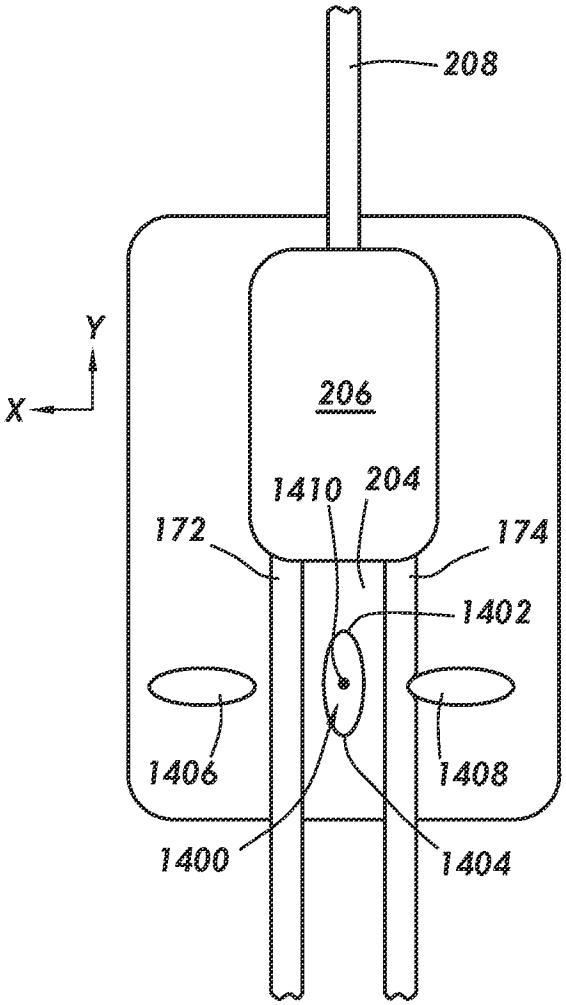

More specifically, as best shown in FIGS. 13A-13B and 14A-14B, the first movable component 1306, 1406 and the second movable component 1308, 1408 are configured to slide along the second direction X. In other words, the first movable component 1306, 1406 and the second movable component 1308, 1408 are configured to move transverse to a direction in which the first and second tubes 172, 174 extend. In addition, in FIGS. 14A and 14B, the central barrier 1400 may be manually rotated about a central barrier pivot point 1410. The at least one motor 1004 includes a first motor 1312 (e.g., stepper motor) and a second motor 1314 (e.g., stepper motor) as shown in FIGS. 13A-13B.

Figure 15C:
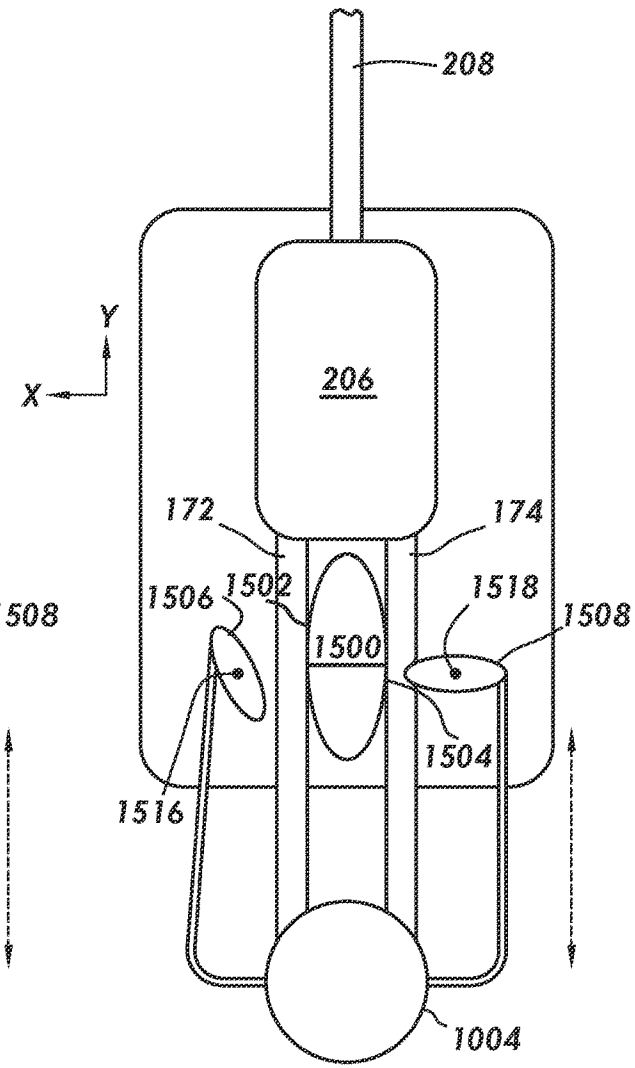
Figure 15B:
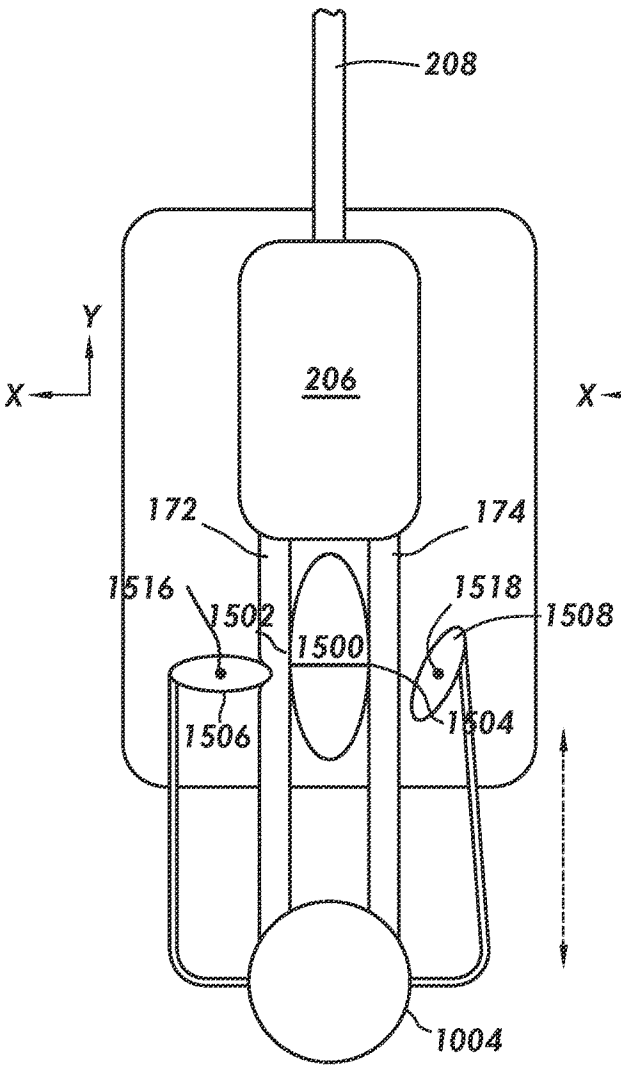
Figure 15A:
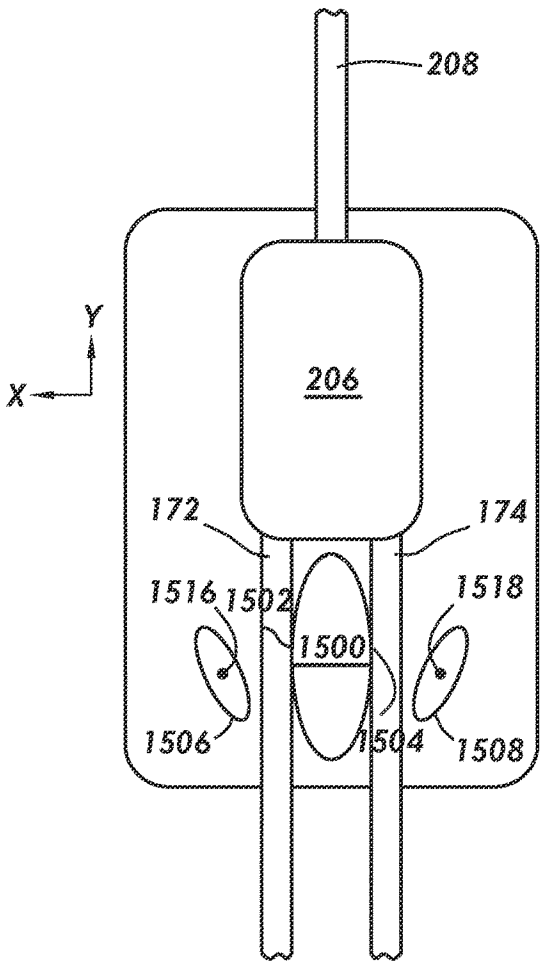

As best shown in FIGS. 15A-15C, the first movable component 1506 and the second movable component 1508 are oblong. The first movable component 1506 and the second movable component 1508 are configured to rotate about respective axes 1516, 1518 extending orthogonally from the front face 202 and spaced from one another.

Figure 16C:
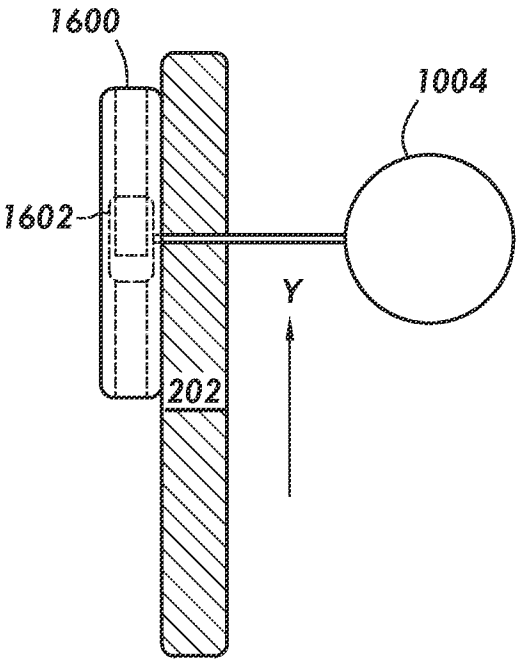
FIG. 16C is a cross-sectional view of a portion of the yet another alternative example of the pinch valve mechanism of FIGS. 16A-16B taken through the section illustrated in FIG. 16B in accordance with at least some embodiments.
Figure 16B:
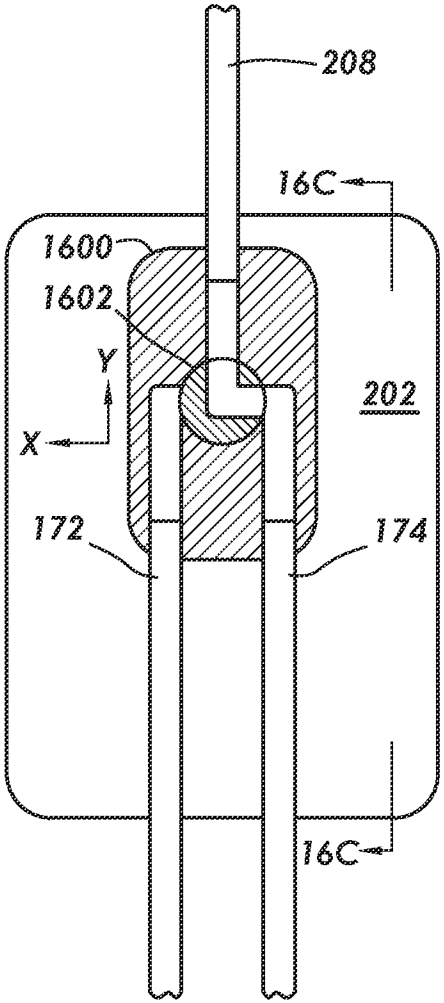
FIGS. 16A-16B show yet another alternative example of the pinch valve mechanism in accordance with at least some embodiments.
Figure 16A:
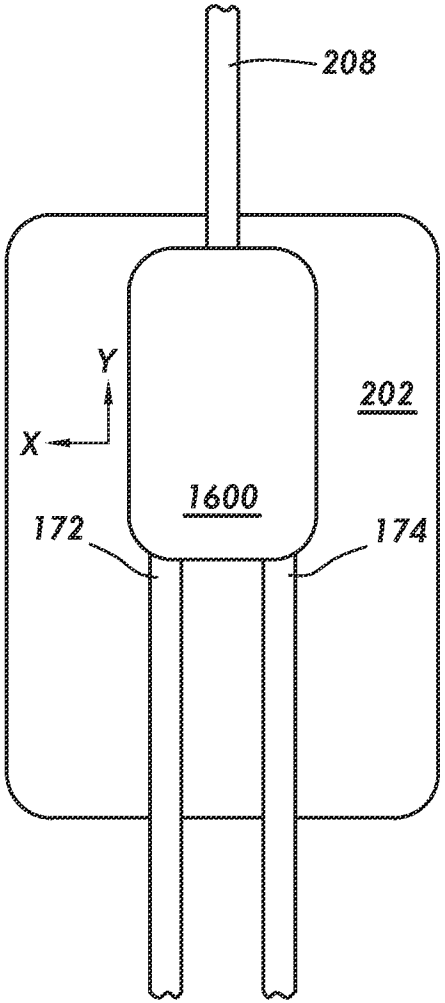

Referring next to FIGS. 16A-16C, which show yet another alternative example of the pinch valve mechanism in accordance with at least some embodiments, the first tube 172 and the second tube 174 both attach to another connector 1600 (similar to connector 206 of FIG. 2) and combine into the outflow tube 208 exiting the connector 1600. The at least one pinch member 180 (FIG. 1) includes a movable portion 1602 of the connector 1600 configured to move relative to the front face 202 (e.g., rotate). The power actuator 182 (FIG. 1) includes at least one motor 1004 operably coupled to the movable portion 1602 of the connector 1600. The at least one motor 1004 is configured to move the movable portion 1602 of the connector 1600 to pinch closed the first tube 172 in the first arrangement. The at least one motor 1004 is also configured to move the movable portion 1602 of the connector 1600 to pinch closed the second tube 174 in the second arrangement. In addition, the at least one motor 1004 is configured to move the movable portion 1602 of the connector 1600 to pinch closed neither the first tube 172 nor the second tube 174 in the third arrangement.

Figure 17B:
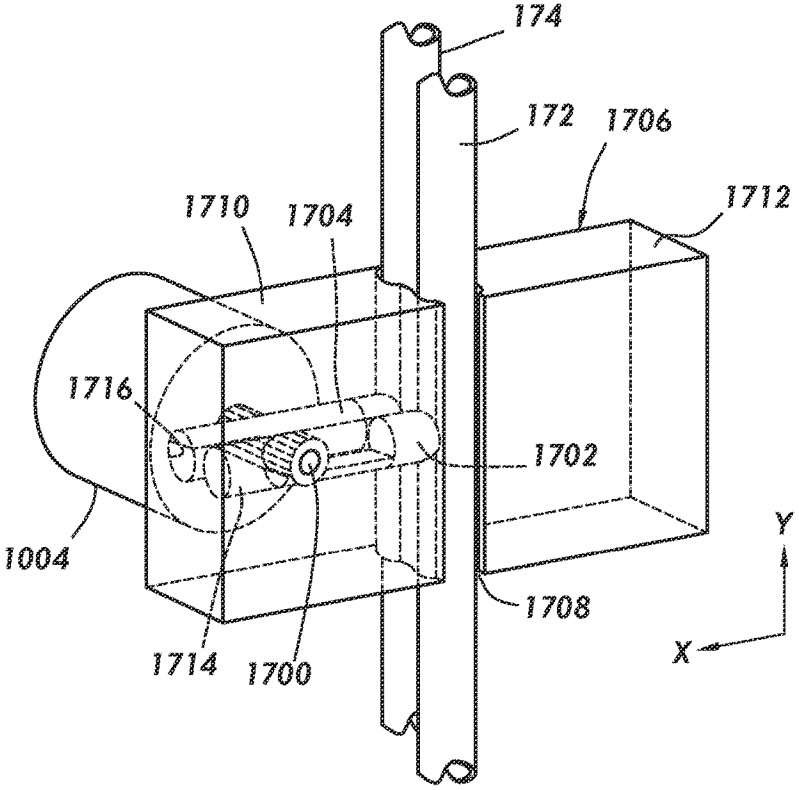
FIGS. 17A-17C show another alternative example of the pinch valve mechanism in accordance with at least some embodiments.
Figure 17A:
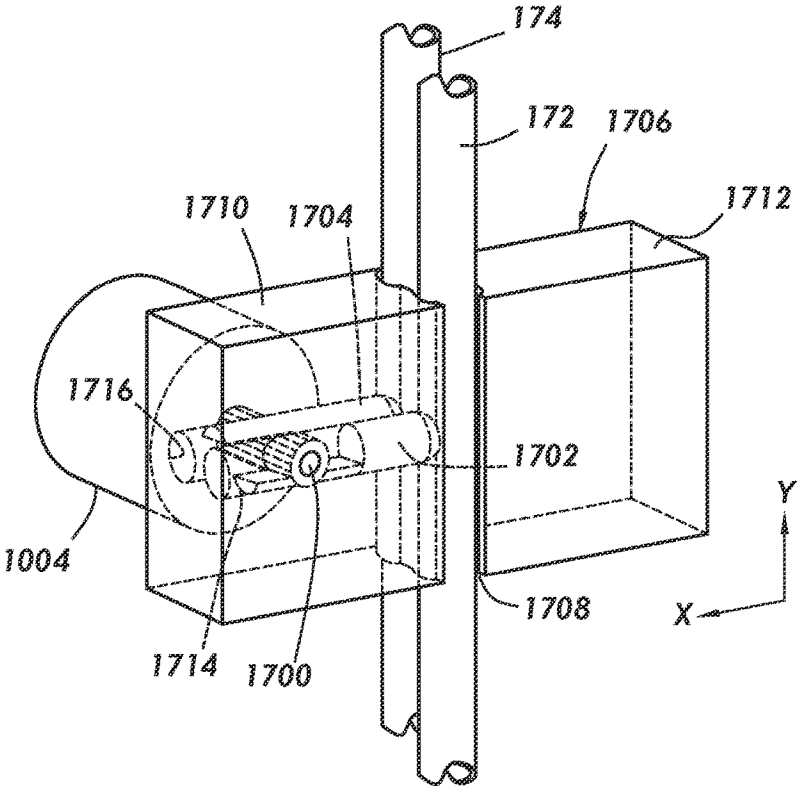
Figure 17C:
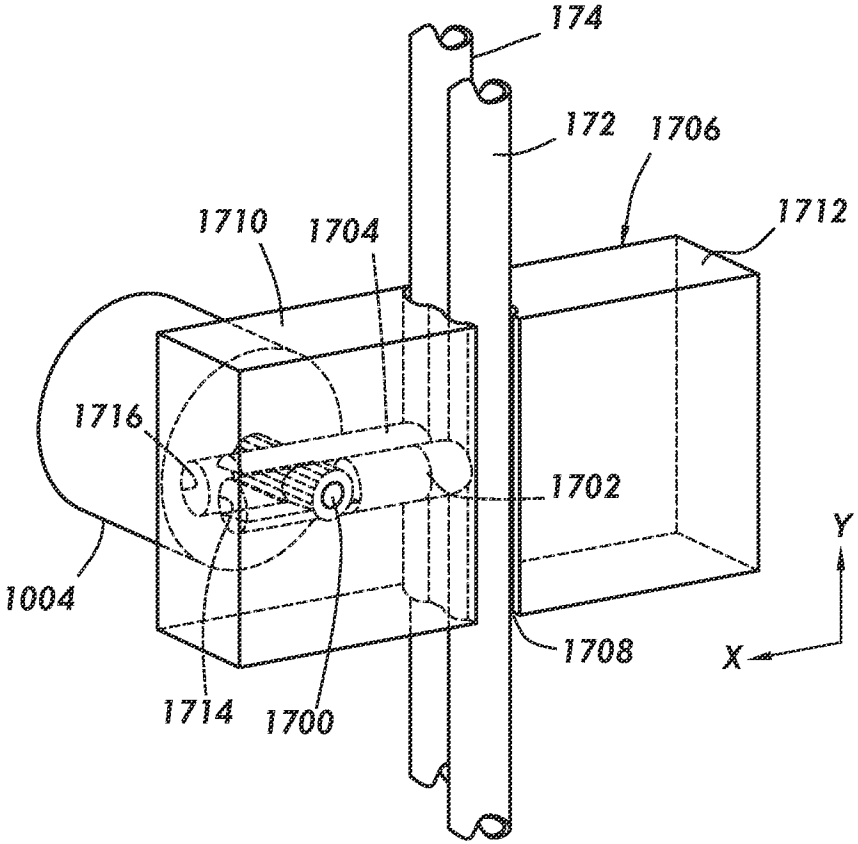

FIGS. 17A-17C show another alternative example of the pinch valve mechanism in accordance with at least some embodiments. The power actuator 182 (FIG. 1) is a motor 1004 with a motor shaft 1700. The at least one pinch member 180 (FIG. 1) includes a first plunger 1702 and a second plunger 1704 that are operatively coupled to the motor shaft 1700 (e.g., via a cam, crank, or rack and pinion mechanism). The at least one tube support 178 includes a block 1706 with a block notch 1708 extending therethrough to define a first block half 1710 and a second block half 1712. The first plunger 1702 and the second plunger 1704 are slidably disposed in the respective plunger channels 1714, 1716 defined by the first block half 1710. The first and second tubes 172, 174 extend along one another (e.g., along the front face 202 in the second direction X) in the block notch 1708. The first and second plungers 1702, 1704 are shown not pinching either the first tube 172 or the second tube 174 in the third arrangement in FIG. 17A. The first plunger 1702 is configured to pinch closed the first tube 172 against the second block half 1712 as the first plunger 1702 is moved by the motor shaft 1700 into the block notch 1708 toward the second block half 1712 of the block 1706 in the first arrangement (FIG. 17B). Similarly, the second plunger 1704 is configured to pinch closed the second tube 174 against the second block half 1712 as the first plunger 1702 is moved by the motor shaft 1700 into the block notch 1708 toward the second block half 1712 of the block 1706 in the second arrangement (FIG. 17C).

Figure 18:
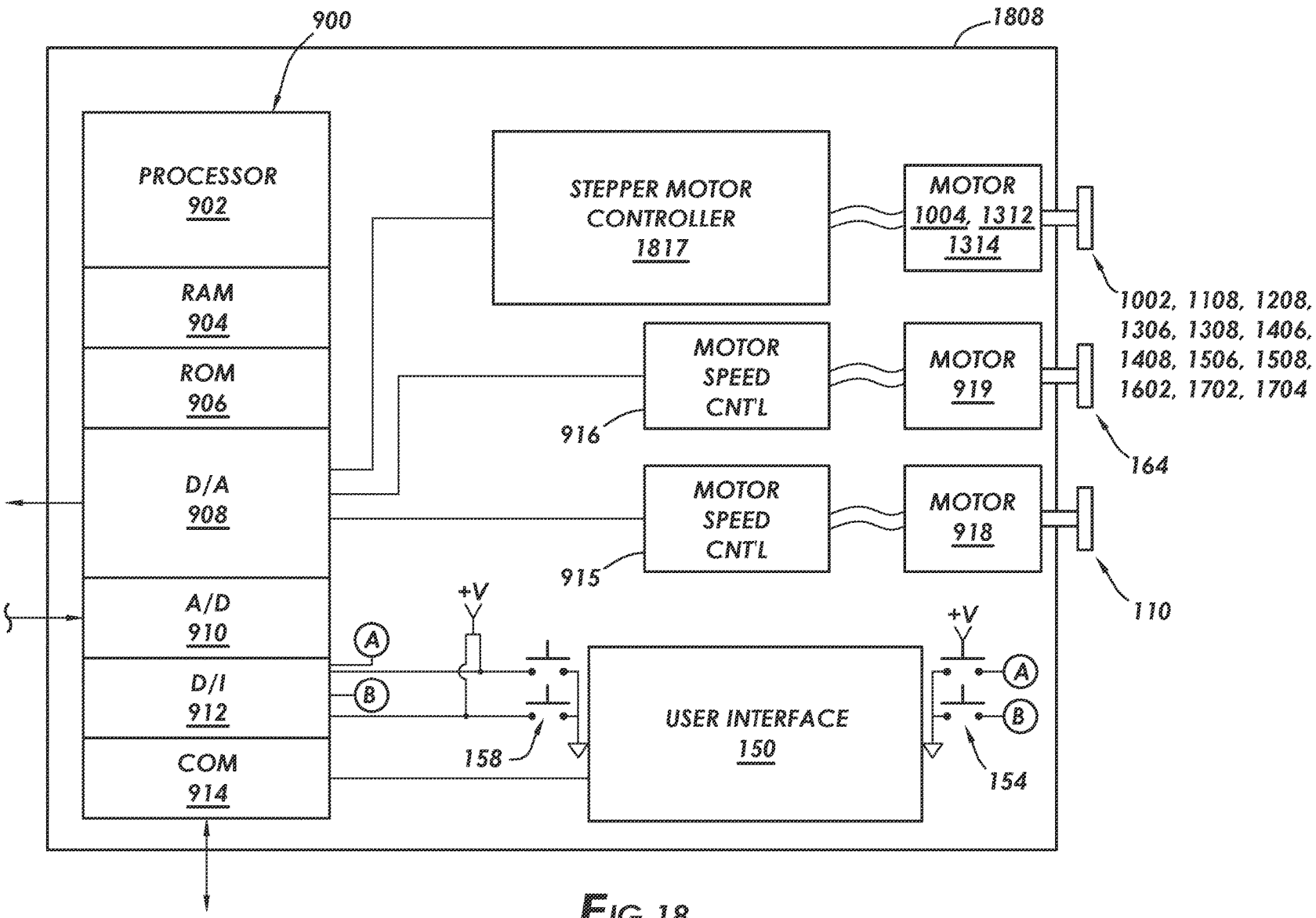
FIG. 18 shows, in block diagram form, another example of the pump system in accordance with at least some embodiments.

FIG. 18 shows, in block diagram form, another example fluid controller 1808 in accordance with at least some embodiments. FIG. 18 is similar to FIG. 9; however, instead of the solenoid assembly 500, 700, 800 acting as the power actuator 182 to move the at least one pinch member 180 using the solenoid controller 917 coupled to the control system 900, the example fluid controller 1808 of FIG. 18 has a motor controller 1817 coupled to the at least one motor 1004, 1312, 1314 and to the control system 900.

Again, the control system 900 may implement various modes of operation related to pumping surgical fluid to the surgical site 112 (FIG. 1) by commanding first peristaltic pump 110 to operate, removing surgical fluid from the surgical site 112 by commanding second peristaltic pump 164, and/or commanding the movement of the at least one pinch member (e.g., single pinch bar 1002, central movable component 1108, 1208, first movable component 1306, 1406, 1506, second movable component 1308, 1408, 1508, movable portion 1602, or first plunger 1702 and second plunger 1704) by the power actuator (e.g., the at least one motor 1004, 1312, 1314). The motor controller 1817 controls the movement of the at least one motor 1004, 1312, 1314 responsive to commands provided from the control system 900. While in the example system the command to the motor controller 1817 can be an analog signal, in other cases the motor controller 1817 may receive commands in packet-based messages (e.g., through the communication logic 914). It is noted that the embodiment of FIG. 18 show the at least one motor 1004, 1312, 1314 as an internal device to the fluid controller 1808; however, in other cases the at least one motor 1004, 1312, 1314 may be an external component to the fluid controller 1808.

So, as in FIG. 9, in example embodiments where the control system 900 is a processor 902, RAM 904, etc., as shown, the ROM 906 and RAM 904 (and possibly other non-transitory storage mediums) store instructions that implement the control of the first and second peristaltic pumps 110, 164 as well as the pinch valve mechanism 176 (FIG. 1). Specifically, as an example, the instructions, when executed by the processor 902, may cause the processor 902 to move the power actuator 182 (FIG. 1) between three orientations that define: the first arrangement of the at least one pinch member 180 (FIG. 1) relative to the at least one tube support 178 (FIG. 1) configured to pinch closed the first tube 172; the second arrangement of the at least one pinch member 180 relative to the at least one tube support 178 configured to pinch closed the second tube 174; and the third arrangement of the at least one pinch member 180 relative to the at least one tube support 178 configured to pinch closed neither the first tube 172 nor the second tube 174.

Figure 19:
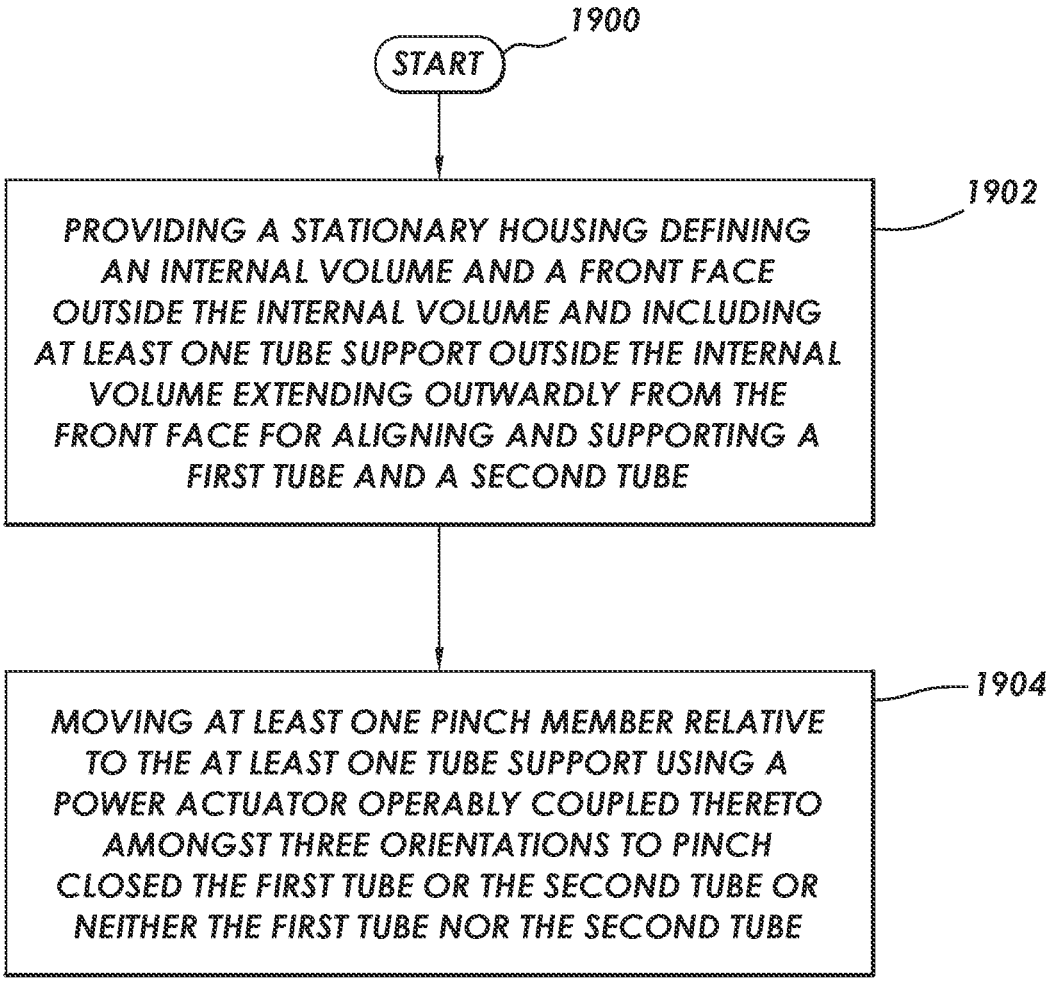
FIG. 19 shows steps of a method of operating the pump system including the outflow pump in accordance with at least some embodiments.

FIG. 19 shows steps of a method of operating the pump system 108, 1808 including the outflow pump 164 in accordance with at least some embodiments. In particular, the method starts (block 1900) and includes the step of 1902 providing a stationary housing 200 defining the internal volume 401 and a front face 202 outside the internal volume 401 extending in a first direction Y and a second direction X transverse to the first direction Y and including at least one tube support 178 outside the internal volume 401 extending outwardly from the front face 202 for aligning and supporting a first tube 172 and a second tube 174. The method continues with the step of 1904 moving at least one pinch member 180 relative to the at least one tube support 178 using a power actuator 182 operably coupled thereto amongst three orientations. The three orientations include: a first arrangement of the at least one pinch member 180 relative to the at least one tube support 178 configured to pinch closed the first tube 172; a second arrangement of the at least one pinch member 180 relative to the at least one tube support 178 configured to pinch closed the second tube 174; and a third arrangement of the at least one pinch member 180 relative to the at least one tube support 178 configured to pinch closed neither the first tube 172 nor the second tube 174.

When the at least one tube support 178 (FIG. 1) includes a t-shaped bracket 300 extending outwardly from the front face 202 and the power actuator 182 (FIG. 1) includes a solenoid assembly 500, 700, 800 coupled to a sliding shaft 400 (e.g., as in FIGS. 2-6), the method further includes the step of providing a first tube notch 306 defined by the t-shaped bracket 300 and a second tube notch 308 defined by the t-shaped bracket 300. The method continues with the step of moving the sliding shaft 400 extending along a longitudinal central axis C through the front face 202 and out of the internal volume 401 of the stationary housing 200 and into a bracket cavity 310 defined by the t-shaped bracket 300 using the solenoid assembly 500. Specifically, such a step includes moving the sliding shaft 400 between one of: a first translational position to move the at least one pinch member 180 (FIG. 1) to the first arrangement, a second translational position to move the at least one pinch member 180 to the second arrangement, and a third translational position to move the at least one pinch member 180 to the third arrangement.

As discussed above with reference to FIG. 4, the at least one pinch member 180 (FIG. 1) may include a first pinch bar 402 adjacent the first tube notch 306 and a second pinch bar 406 adjacent the second tube notch 308 each extending radially from the longitudinal central axis C and offset from one another along the longitudinal central axis C. Thus, the method further includes the step of moving the first pinch bar 402 toward the front face 202 (i.e., pulling the first tube 172 toward the front face 202) in response to the sliding shaft 400 moving to the first translational position. Next, moving the second pinch bar 406 away from the front face 202 toward a support beam 304 of the t-shaped bracket 300 spaced from the front face 202 and extending along the second direction X (i.e., pushing the second tube 174 toward the support beam 304) in response to the sliding shaft 400 moving to the second translational position. The method continues with the step of maintaining spacing of the first pinch bar 402 from the front face 202 of a first notch width 404 and of the second pinch bar 406 from the front face 202 of a second notch width 408 (i.e., releasing the first tube 172 and the second tube 174) when the sliding shaft 400 is in the third translational position.

Also, the solenoid assembly 500 can include a first solenoid 502 and a second solenoid 510, so the method further includes the step of energizing a first coil 504 of the first solenoid 502. Next, moving a first solenoid core 506 of the first solenoid 502 in a first core direction 508 along a first core axis $C_1$ in parallel to the longitudinal central axis C from a first core initial position corresponding to the third translational position of the sliding shaft 400 to a first core extended position corresponding to the first translational position of the sliding shaft 400 in response to the first coil 504 being energized. The method continues by returning the first solenoid core 506 to the first core initial position in response to the first coil 504 not being energized. The method continues with the step of energizing a second coil 512 of the second solenoid 510. Next, moving a second solenoid core 514 of the second solenoid 510 in a second core direction 516 along a second core axis $C_2$ in parallel to the longitudinal central axis C opposite the first core direction 508 from a second core initial position corresponding to the third translational position of the sliding shaft 400 to a second core extended position corresponding to the second translational position of the sliding shaft 400 in response to the second coil 512 being energized. The method also includes the step of returning the second solenoid core 514 to the second core initial position in response to the second coil 512 not being energized.

The method can further include the step of reducing a voltage supplied to the solenoid assembly 500, 700, 800 from an initial voltage to a predetermined reduced voltage after a predetermined amount of time using a solenoid controller coupled to the solenoid assembly 500, 700, 800. The next step of the method is reducing an amount of power required to maintain a pinch applied by the at least one pinch member 180 (e.g., to the first tube 172) in the first translational position of the sliding shaft 400 and by the at least one pinch member 180 (e.g., to the second tube 174) in the second translational position of the sliding shaft 400 in the second translational position of the sliding shaft 400.

Also as discussed above with reference to FIGS. 13A-15C, the at least one tube support 178 (FIG. 1) can include a central barrier 1300, 1400, 1500 extending outwardly from the front face 202 (e.g., through the tubing gap 204). The at least one pinch member 180 (FIG. 1) can include a first movable component 1306, 1406, 1506 and a second movable component 1308, 1408, 1508 each extending outwardly from the front face 202 and selectively spaced from the central barrier 1300, 1400, 1500. The power actuator 182 (FIG. 1) may include at least one motor 1004 operably coupled to the first movable component 1306, 1406, 1506 and the second movable component 1308, 1408, 1508. Consequently, the method further includes the step of moving the first movable component 1306, 1406, 1506 toward a first central barrier side 1302, 1402, 1502 of the central barrier 1300, 1400, 1500 (e.g., to pinch the first tube 172 against the first central barrier side 1302 of the central barrier 1300, 1400, 1500) in the first arrangement. In addition, the method also includes the step of moving the first movable component 1306, 1406, 1506 away from the first central barrier side 1302, 1402, 1502 of the central barrier 1300, 1400, 1500 in the third arrangement (e.g., to release the second tube 174). The method also includes the step of moving the second movable component 1308, 1408, 1508 toward a second central barrier side 1304, 1404, 1504 of the central barrier 1300, 1400, 1500 opposite the first central barrier side 1302, 1402, 1502 (e.g., to pinch the second tube 174 against the second central barrier side 1304, 1404, 1504 of the central barrier 1300, 1400, 1500) in the second arrangement. Also, the method includes the step of moving the second movable component 1308, 1408, 1508 away from the second central barrier side 1304, 1404, 1504 of the central barrier 1300, 1400, 1500 in the third arrangement (e.g., to release the second tube 174).

As discussed above with reference to FIGS. 11A-11C and 12A-12B, the at least one tube support 178 (FIG. 1) can include a first barrier 1100, 1200 extending outwardly from the front face 202 and a second barrier 1104, 1204 extending outwardly from the front face 202 and spaced from the first barrier. In addition, the at least one pinch member 180 (FIG. 1) can include a central movable component 1108, 1208 extending outwardly from the front face 202 and disposed between the first barrier and the second barrier 1104, 1204 (e.g., disposed in the tubing gap 204). The power actuator 182 can also include at least one motor 1004 operably coupled to the central movable component 1108, 1208. Thus, the method further includes the step of moving the central movable component 1108, 1208 toward a first barrier edge 1102, 1202 of the first barrier 1100, 1200 extending along the first direction Y in the first arrangement. In addition, the method includes the step of moving the central movable component 1108, 1208 away from the first barrier edge 1102, 1202 of the first barrier 1100, 1200 in the third arrangement. The method also includes the step of moving the central movable component 1108, 1208 toward a second barrier edge 1106, 1206 of the second barrier 1104, 1204 extending along the first direction Y in the second arrangement. Additionally, the method includes the step of moving the central movable component 1108, 1208 away from the second barrier edge 1106, 1206 of the second barrier 1104, 1204 in the third arrangement.

More specifically, the first barrier edge 1102 and second barrier edge 1106 can directly face one another (see e.g., FIGS. 11A-11C) and the central movable component 1108 extends along the second direction X from a first central component end 1110 to a second central component end 1112. So, the method further includes the step of rotating the second central component end 1112 of the central movable component 1108 toward the first barrier edge 1102 of the first barrier 1100 in the first arrangement using a central component shaft of the at least one motor 1004 extending through the front face 202 and rotatable about a first central component end axis $C_1$ disposed at the first central component end 1110. The method also includes the step of rotating the second central component end 1112 of the central movable component 1108 away from the first barrier edge 1102 of the first barrier 1100 in the third arrangement using the central component shaft of the at least one motor 1004. In addition, the method includes the step of rotating the second central component end 1112 of the central movable component 1108 toward the second barrier edge 1106 of the second barrier 1104 in the second arrangement using the central component shaft of the at least one motor 1004. The method additionally includes the step of rotating the second central component end 1112 of the central movable component 1108 away from the second barrier edge 1106 of the second barrier 1104 in the third arrangement using the central component shaft of the at least one motor 1004.

Alternatively if the first barrier 1200 and the second barrier 1204 are offset from one another along the first direction Y and the first barrier edge 1202 and the second barrier edge 1206 do not directly face one another and the central movable component 1108 extends along the second direction X from a first central component side 1214 to a second central component side 1216 (see e.g., FIGS. 12A-12B), the method further includes the step of sliding the central movable component 1208 along the first direction Y toward the first barrier 1200 in the first arrangement using the at least one motor 1004. In addition, the method includes the step of sliding the central movable component 1208 along the first direction Y away from the first barrier 1200 in the third arrangement using the at least one motor 1004. The method also includes the step of sliding the central movable component 1208 along the first direction Y toward the second barrier 1204 in the second arrangement using the at least one motor 1004. Also, the method includes the step of sliding the central movable component 1208 along the first direction Y away from the second barrier 1204 in the third arrangement using the at least one motor 1004.

As previously discussed with reference to FIGS. 16A-16C, the first tube 172 and the second tube 174 can both attach to a connector 1600 and combine into an outflow tube exiting the connector 1600. The at least one pinch member 180 can include a movable portion 1602 of the connector 1600 being movable relative to the front face 202 and the power actuator 182 can include a motor 1004 operably coupled to the movable portion 1602 of the connector 1600. Thus, the method further includes the step of moving the movable portion 1602 of the connector 1600 to pinch closed the first tube 172 in the first arrangement. Additionally, the method includes the step of moving the movable portion 1602 of the connector 1600 to pinch closed the second tube 174 in the second arrangement. The method also includes the step of moving the movable portion 1602 of the connector 1600 to pinch closed neither the first tube 172 nor the second tube 174 in the third arrangement.

The above discussion is meant to be illustrative of the principles and various embodiments of the present invention. Numerous variations and modifications will become apparent to those skilled in the art once the above disclosure is fully appreciated. For example, other pinch valve mechanisms that move normal to the front face of the stationary housing may be used. It is intended that the following claims be interpreted to embrace all such variations and modifications.

What is claimed is:

1. A pump system including an outflow pump, the pump system comprising:

a stationary housing defining an internal volume and a front face outside the internal volume extending in a first direction and a second direction transverse to the first direction;

the stationary housing including at least one tube support outside the internal volume extending outwardly from the front face for aligning and supporting a first tube and a second tube;

at least one pinch member being movable relative to the at least one tube support;

a power actuator disposed in the internal volume and operably coupled to the at least one pinch member, the power actuator configured to have three orientations that define:

a first arrangement of the at least one pinch member relative to the at least one tube support configured to pinch closed the first tube, a second arrangement of the at least one pinch member relative to the at least one tube support configured to pinch closed the second tube, and a third arrangement of the at least one pinch member relative to the at least one tube support configured to pinch closed neither the first tube nor the second tube;

the at least one tube support including a t-shaped bracket having a central post extending outwardly from the front face along a longitudinal central axis and including a support beam attached to and extending across the central post and spaced from and along the front face in the second direction;

the t-shaped bracket defining a bracket cavity leading to the internal volume and extending through the central post and into the support beam;

the t-shaped bracket defining a first tube notch configured to accept the first tube and a second tube notch configured to accept the second tube;

the power actuator including:

a sliding shaft extending along the longitudinal central axis through the front face and out of the internal volume into the bracket cavity;

a solenoid assembly coupled to the sliding shaft, the sliding shaft movable by the solenoid assembly along the longitudinal central axis to:

a first translational position to move the at least one pinch member to the first arrangement, a second translational position to move the at least one pinch member to the second arrangement, and a third translational position to move the at least one pinch member to the third arrangement;

a first pinch bar extending radially from the longitudinal central axis at a distal end of the sliding shaft in a first lateral direction along the support beam into the bracket cavity adjacent the first tube notch and configured to move toward the front face when the sliding shaft is moved to the first translational position while maintaining spacing of a first notch width with the front face when the sliding shaft moves to the third translational position; and a second pinch bar extending radially from the longitudinal central axis in a second lateral direction opposite the first lateral direction into the bracket cavity and offset from the first pinch bar along the longitudinal central axis by a second notch width and along and spaced from the support beam and configured to move away the front face when the sliding shaft is moved to the second translational position while maintaining spacing of the second notch width with the front face when the sliding shaft moves to the third translational position.

2. The pump system as set forth in claim 1, wherein the solenoid assembly includes:

a first solenoid having a first coil fixedly attached to the stationary housing and having a first solenoid core extending and movable along a first core axis in parallel to the longitudinal central axis, the first solenoid configured to move the first solenoid core in a first core direction along the first core axis from a first core initial position corresponding to the third translational position of the sliding shaft to a first core extended position corresponding to the first translational position of the sliding shaft in response to the first coil being energized and return to the first core initial position in response to the first coil not being energized;

a second solenoid having a second coil fixedly attached to the stationary housing and having a second solenoid core extending and movable along a second core axis in parallel to the longitudinal central axis and spaced from the first core axis, the second solenoid configured to move the second solenoid core in a second core direction along the second core axis opposite the first core direction from a second core initial position corresponding to the third translational position of the sliding shaft to a second core extended position corresponding to the second translational position of the sliding shaft in response to the second coil being energized and return to the second core initial position in response to the second coil not being energized; and a z-shaped bracket including a central portion extending rectilinearly in parallel to the longitudinal central axis and including a first arm extending orthogonally to the longitudinal central axis and attached to the first solenoid core and the sliding shaft and a second arm extending orthogonally to the longitudinal central axis and attached to the second solenoid core for moving the sliding shaft along the longitudinal central axis.

3. The pump system as set forth in claim 1, further including a solenoid controller coupled to the solenoid assembly and configured to reduce a voltage supplied to the solenoid assembly from an initial voltage to a predetermined reduced voltage after a predetermined amount of time thereby reducing an amount of power required to maintain a pinch applied by the at least one pinch member in the first translational position of the sliding shaft and by the at least one pinch member in the second translational position of the sliding shaft in the second translational position of the sliding shaft.

4. A pump system including an outflow pump, the pump system comprising:

a stationary housing defining an internal volume and a front face outside the internal volume extending in a first direction and a second direction transverse to the first direction;

the stationary housing including at least one tube support outside the internal volume extending outwardly from the front face for aligning and supporting a first tube and a second tube;

at least one pinch member being movable relative to the at least one tube support;

a power actuator disposed in the internal volume and operably coupled to the at least one pinch member, the power actuator configured to have three orientations that define:

a first arrangement of the at least one pinch member relative to the at least one tube support configured to pinch closed the first tube, a second arrangement of the at least one pinch member relative to the at least one tube support configured to pinch closed the second tube, and a third arrangement of the at least one pinch member relative to the at least one tube support configured to pinch closed neither the first tube nor the second tube;

the at least one tube support including a t-shaped bracket having a central post extending outwardly from the front face along a longitudinal central axis and including a support beam attached to and extending across the central post and spaced from and along the front face in the second direction;

the t-shaped bracket defining a bracket cavity leading to the internal volume and extending through the central post and into the support beam;

the t-shaped bracket defining a first tube notch configured to accept the first tube and a second tube notch configured to accept the second tube;

the power actuator including:

a sliding shaft extending along the longitudinal central axis through the front face and out of the internal volume into the bracket cavity; and a solenoid assembly coupled to the sliding shaft, the sliding shaft movable by the solenoid assembly along the longitudinal central axis to:

a first translational position to move the at least one pinch member to the first arrangement, a second translational position to move the at least one pinch member to the second arrangement, and a third translational position to move the at least one pinch member to the third arrangement;

a first solenoid having a first coil fixedly attached to the stationary housing and having a first solenoid core extending and movable along a first core axis in parallel to the longitudinal central axis, the first solenoid configured to move the first solenoid core in a first core direction along the first core axis from a first core initial position corresponding to the third translational position of the sliding shaft to a first core extended position corresponding to the first translational position of the sliding shaft in response to the first coil being energized and return to the first core initial position in response to the first coil not being energized;

a second solenoid having a second coil fixedly attached to the stationary housing and having a second solenoid core extending and movable along a second core axis in parallel to the longitudinal central axis and spaced from the first core axis, the second solenoid configured to move the second solenoid core in a second core direction along the second core axis opposite the first core direction from a second core initial position corresponding to the third translational position of the sliding shaft to a second core extended position corresponding to the second translational position of the sliding shaft in response to the second coil being energized and return to the second core initial position in response to the second coil not being energized; and a z-shaped bracket including a central portion extending rectilinearly in parallel to the longitudinal central axis and including a first arm extending orthogonally to the longitudinal central axis and attached to the first solenoid core and the sliding shaft and a second arm extending orthogonally to the longitudinal central axis and attached to the second solenoid core for moving the sliding shaft along the longitudinal central axis.

5. The pump system as set forth in claim 4, further including a solenoid controller coupled to the solenoid assembly and configured to reduce a voltage supplied to the solenoid assembly from an initial voltage to a predetermined reduced voltage after a predetermined amount of time thereby reducing an amount of power required to maintain a pinch applied by the at least one pinch member in the first translational position of the sliding shaft and by the at least one pinch member in the second translational position of the sliding shaft in the second translational position of the sliding shaft.

* * * * *